US007882721B2

(12) United States Patent
Gombas

(10) Patent No.: US 7,882,721 B2
(45) Date of Patent: Feb. 8, 2011

(54) CONTAINER BODYMAKER

(76) Inventor: Laszlo A. Gombas, 23768 Shooting Star Dr., Golden, CO (US) 80401

( * ) Notice: Subject to any disclaimer, the term of this patent is extended or adjusted under 35 U.S.C. 154(b) by 491 days.

(21) Appl. No.: 11/838,888

(22) Filed: Aug. 15, 2007

(65) Prior Publication Data

US 2008/0041133 A1 Feb. 21, 2008

Related U.S. Application Data

(63) Continuation-in-part of application No. 11/309,514, filed on Aug. 16, 2006, now Pat. No. 7,434,442.

(51) Int. Cl.
*B21D 22/00* (2006.01)
*B21J 9/18* (2006.01)

(52) U.S. Cl. ..... 72/347; 72/449

(58) Field of Classification Search ..... 72/347–349, 72/449, 450, 452.4, 452.5, 455, 456
See application file for complete search history.

(56) References Cited

U.S. PATENT DOCUMENTS 3,696,657 A 10/1972 Maytag
4,173,138 A 11/1979 Main et al.
4,934,167 A 6/1990 Grimms et al.
4,956,990 A 9/1990 Williams
4,996,865 A * 3/1991 Haulsee et al. ..... 72/349
5,257,523 A 11/1993 Hahn et al.
5,335,532 A 8/1994 Mueller et al.
5,546,785 A 8/1996 Platt et al.
5,564,300 A 10/1996 Mueller
5,735,165 A 4/1998 Schockman et al.

* cited by examiner

*Primary Examiner*—Dana Ross
*Assistant Examiner*—Teresa M Bonk
(74) *Attorney, Agent, or Firm*—Kyle W. Rost

(57) ABSTRACT

A container bodymaker gearbox (20, 130) drives rams (60, 66) linearly by use of a hypocycloid drive that controls operation of a rotating and orbiting output shaft (40) by synchronizing the rotating and orbiting motion such that a tracking point at a predetermined radius from the shaft 40 tracks a straight line. A coaxial sleeve (124) is spaced around shaft (40) and carries an annular crank hub (140) on bearings (142). The crank hub (140) is eccentrically mounted on the sleeve (124) with the hub centerpoint positioned to track the straight line tracking point. A rotary ring (166) mounted around the periphery of the crank hub (140) supports diametrically opposed connections (176) to rams (60, 66). The ring (166) and rams (60, 66) translate on the straight-line path determined by the centerpoint, with the hub (140) rotating as required within the ring (166) to cancel rotary motion of hub (14) from the translational motion of the ring (166).

11 Claims, 25 Drawing Sheets

CONTAINER BODYMAKER

CROSS-REFERENCE TO RELATED APPLICATION

This application is a continuation-in-part of U.S. patent application Ser. No. 11/309,514, filed Aug. 16, 2006, copending.

BACKGROUND OF THE INVENTION

1. Field of the Invention

The invention generally relates to improvements in a metal deforming mechanism that drives a tool by a link-actuated tool support. In another aspect, the invention generally relates to improvements in metal deforming by a tool carrier such as a press frame with a guide for a rectilinearly moving tool. More specifically, the invention relates to a bodymaker for producing container bodies from a blank or preformed cup. In a specific application, the invention relates to a bodymaker for forming metal can bodies by a draw-and-iron process. The invention also contemplates the use of a bodymaker for forming cans of materials other than metal, which may include plastic, composites, polymer co-extruded laminate materials, or still other materials.

2. Description of Related Art Including Information Disclosed Under 37 CFR 1.97 and 1.98

The food can, beverage container, and the like have evolved into a sophisticated article of manufacture. The method of forming a container body from metal sheet stock is well known. This process is known as draw-and-iron. The typical steps of this process are described, below. Over many years, variations, improvements and refinements have been applied to the fundamental steps of the method. Some of these steps may have been significantly modified, supplemented, or eliminated according to different practices.

Metal containers are formed from metal sheet stock, which is initially selected to be of a specified thickness that is sufficient to produce a competent end product. For purposes of economy and efficient design of the finished container body, the selected sheet stock is chosen to be as thin as possible. During processing, parts of the sheet stock are greatly reduced in thickness. The ability to adequately manufacture the portions subject to the greatest reduction can be a limiting factor in the determination and selection of the suitable starting sheet stock thickness or the necessary size of the initial blank cut from the sheet stock. Consequently, improved forming techniques can produce significant economies by allowing the use of less metal or other materials than might be required by other techniques. Alternatively, improved forming techniques can improve economy by producing container bodies at a greater rate, with improved quality, and with reduced rejection rate.

The first step for manufacturing a container body of predetermined diameter and height is to form a container blank from metal sheet stock. The metal sheet stock is cut to produce a disc. In a continuous process performed within the same machine that cuts the disc, the disc is preformed into a shallow cup. The cup-shaped blank is considerably wider in diameter and shorter in height then the predetermined diameter and height of the end-product container body.

The wide, cup-shaped blank is fed into a bodymaker, which is a specifically designed punch that employs a linear reciprocating ram to drive the blank through dies in a tool pack. Initially, the bodymaker advances a redraw sleeve against the blank to clamp the blank in aligned position with respect to the path of the ram. In a single stroke, the ram advances along an axial path to engage the blank and to drive the blank along the longitudinal ram axis that extends through the tool pack. The tool pack typically consists of a series of dies supported concentrically about the ram axis. The initial die is a metal deforming redraw die that reconfigures the blank from a shallow, wide cup into a narrower and longer cup of similar diameter to the predetermined diameter of the end-product container body. The subsequent dies of the tool pack are a plurality of ring dies that iron the sidewall of this narrowed blank to form a substantially taller container body. As the ram stroke reaches its maximum extension, the ram drives the bottom of the container body against a bottom-forming doming die that imparts a new shape to the bottom of the can body. The ram then reverses direction. As the ram moves in reverse, compressed air or other means removes the formed can body from the ram and the can body exits the bodymaker.

As produced by the bodymaker, this container body is closed at one end, referred to as the bottom, and open at the other, referred to as the top. In subsequent processing, the open top end is trimmed to define a container body of the predetermined height and to form a uniform edge at the open top end. Typically the trimmed edge is necked-in and flanged, allowing a small lid to be applied. Before the lid is applied, the container body can be filled with selected contents through the open end. The edge of the lid and the edge of the container body are joined together by a seaming process, producing a finished, closed container.

The type of container body with integral sidewall and bottom wall is called a one-piece container body, and the type of finished container formed from this container body and an applied lid is called a two-piece can or two-piece container.

The technology for forming a one-piece container body originated from an effort to produce beverage containers from aluminum metal. The initial technical achievement was to consistently produce a reasonably uniform aluminum container body that could be used for commercial purposes with automated production and filling equipment. This achievement was realized, and the technology subsequently was expanded to produce similar one-piece cans of steel. Cans of similar structure are known in several different materials, now also including plastic.

After the basic techniques for forming one-piece bodies were developed, the technology improved in many respects. One of the dominant goals has been to reduce the cost of each can. Cost reduction typically translates into reducing the amount of raw material, such as aluminum, that is necessary to reliably produce a can body. A reduction in the quantity of metal can be achieved by a variety of modifications. Selecting a thinner starting sheet stock or cutting a disc of smaller diameter will achieve material savings, provided the predetermined end product can be produced reliably. According to other schemes, the initial blank can be cut in a special configuration that employs a reduced quantity of metal.

Each part of the can has been designed and refined to minimize wall thickness to the extent possible with each progressive advance in technology. Thus, the raw sheet stock needed to produce a one-piece container body is now considerably thinner than was necessary several decades ago. The thickness of present day aluminum sheet stock is in the range from 0.010 to 0.011 inches. The sidewall profile of a one-piece aluminum container body reflects the sophistication of various technological advances, with the specification for sidewall thickness at the center of the can height being about 0.004 inches or 0.1 mm, which is extremely thin. The sidewall lends itself to the greatest amount of working in the bodymaker and, thus, tends to be the thinnest portion of the container body. The bottom end is considerably thicker but is far more difficult to work into a thinner structure. Thus, the sidewall is considered to be the limiting structure of the container body. The minimum thickness of the starting sheet stock or the minimum diameter of the blank disc is limited by the ability of the forming equipment to form the sidewall.

To mass-produce container bodies of such thinness requires reliable precision in the equipment that manufactures the container body. If the reliable level of precision can be increased, then various benefits and cost savings become possible. On one hand, the rejection rate or scrap rate might be reduced, reflecting that a larger percent of the container bodies coming from a bodymaker are of useable quality. On the other hand, it may be possible to achieve additional reductions in specified wall thickness, where a present specification of wall thickness incorporates provision for lack-of-precision in the manufacturing process. For example, the specification of sidewall thickness may accommodate known or expected inaccuracy in bodymaker performance. Opposite side areas of a can body sidewall may be, respectively, a thin side and the thick side, perhaps averaging about 0.004 in. The deviations or tolerances between the top or bottom locations of the thin wall are about 0.0005 inches in a standard bodymaker of prior art construction.

It would be desirable to minimize or almost totally eliminate this deviation. Eliminating this deviation should result in substantial savings of can wall material. Better accuracy in the bodymaker enables a further possible cost reduction from an improved ability to use a different alloy or material content. Still another saving may arise by the ability to operate the bodymaker at a higher speed. The exact source and amount of cost savings is subject to future development, but expectation that better accuracy in bodymaker performance will lead to savings is well accepted.

It was recognized in the early days of forming one-piece container bodies that the original rotary motion of a motor must be translated into near-linear motion in order to drive a container body blank along a linear axis through forming dies of a tool pack. Initial bodymakers employed the slider-crank mechanism, which remains the mechanism in active use, today. A slider-crank mechanism converts circular motion into oscillating linear motion.

Rotary or circular motion is the essential driving output of commercial motors and is the power source for the vast majority of industrial machines. Rotary motors are a preferred drive mechanism for many applications where reciprocating motion is required in a cycle of machine operation. A rotary motor can drive a rotary operating mechanism such as a crank arm, which rotates in a first or forward direction for one half of its cycle and then completes its rotary cycle in an opposite or rearward direction for the second half of each cycle. Rotary motion is highly desirable because it enables a machine to reciprocate without altering the rotational direction of motor operation. The motor can continue to operate at high speed, in a single direction of rotation. In addition, a flywheel is desirable in a bodymaker because it adds rotating mass. Often a rotary electric motor will drive a flywheel that carries the crank arm or operates on a concentric axis with the crank arm.

Interest in converting rotary motion into near-linear motion rose to considerable importance in the eighteenth century when American inventor James Watt and others developed industrial machinery including steam engines and railroad engines. A large number of conversion linkages were developed, although none are considered to be exact. In the nineteenth century, the French engineer, Peaucellier, and Russian mathematician, Lipkin, independently developed an eight-bar linkage that is regarded as the first to produce exact straight-line motion. This linkage, now known as the Peaucellier Straight-line Mechanism, is a diamond shaped linkage of four pivoted bars with two opposite pivot points cross-connected by a two-part bar that is pivoted at its center. This linkage has been applied to can bodymakers but has the disadvantage of employing pivoting links that must, to some degree, rock or reciprocate. It is generally desirable in a bodymaker to minimize the number of rocking or reciprocating parts and the overall mass of reciprocating elements.

While the Peaucellier mechanism produces a straight line, it complicates the component linkages between a drive system and a ram. The added linkages augment the moving mass of slider-crank motion, increasing the mass that periodically must be reversed. It would be desirable to employ a technology that substantially eliminates the inherent inaccuracy associated with a slider-crank motion. For this purpose, it would be desirable to employ a movement based on rolling motion or rotation of substantially all elements. A hypocycloid straight-line mechanism employs the mathematical relationship between one circle rolling inside another circle to define a straight line. A point on the circumference of a circle rolling on the inside of another circle generates a curve called a hypocycloid. When the diameter of the rolling circle is one half that of the outer circle, the curve traced by a point on the circumference of the smaller circle is a true straight line. This concept is demonstrated by use of a planetary gear that can be rotated around the inside circumference of a ring gear to move a slider with straight motion.

Certain linear motors and mechanisms for converting linear motion to rotary motion are known, but their application to a bodymaker is limited by many factors. A first is that hypocycloid motor seeks to convert linear motion of a piston to rotary motion of a driven wheel, which is the opposite force pattern required in a bodymaker. A second is that a bodymaker tends to employ considerable moving mass. A bodymaker is expected to drive the ram with a force from about eight thousand to twelve thousand pounds in order to produce a metal can body. This force must be produced on each stroke of the ram at a rate of several hundred strokes per minute. The stroke of the ram must reverse with the same frequency in order to withdraw the ram after each forward stroke. Withdrawing the ram is necessary in order to discharge the formed container body and to receive a new can body blank for use in the next stroke. Many linear drive devices are poorly suited to drive a substantial mass through acceleration, deceleration, and direction reversal, while achieving the necessary force levels per stroke and while achieving smooth and nearly vibration-free operation. Thus, force, speed, and prompt reversal must be achieved in a compact space suited for use in a factory, in an industrial can line, which is a series of machines that work in sequence within a manufacturing plant to produce a finished can body. In meeting these combined requirements, the rotary motor is the clear choice of driver, and a driven, rotating large mass such as a flywheel with a crank arm and slider are a capable solution.

U.S. Pat. No. 3,696,657 to John Hardy Maytag is often regarded as being the pioneering patent in the art of bodymakers. The general arrangement of Maytag's bodymaker remains in use, although with modifications. Maytag employs a classic slider-crank mechanism in which a rotary motor drives a crank arm, which likewise operates in a rotary cycle. The crank arm often is considered to rotate on a Z-axis of an X-Y-Z axis coordinate system. A first or rear end of a main connecting rod is rotatably connected to the crank arm at a predetermined throw length or working radius from the center of crank rotation. The front or second end of the main connecting rod was connected via intermediate linkages to the bodymaker ram. In turn, the ram was mounted on a carriage and guided by rollers traveling over linear carriageway strips to accurately guide the ram for movement along a linear axis aligned with the tool pack.

The reciprocal, forward and rearward motion of the ram can be regarded as X-axis movement. Likewise, the crank throws of the crank arm produce an X-axis component at the forward and rearward ends of each half-cycle that brings the ram to its respective forward and rearward extreme positions. However, the rotary action of the crank inherently adds an additional Y-axis or lateral offset component at all rotary positions intermediate to the end points of the forward and rearward half-cycles. Thus, the main connecting rod moves with rocking motion wherein the first end of the connecting rod follows a circular path that not only provides a useful reciprocal component with respect to an X-axis but also provides an undesirable deviation along a Y-axis. The Y-axis components are considered to contribute vibration to the bodymaker as a whole and to cause inaccuracy or limited accuracy in the linear, X-axis motion of the ram. Misalignments of the ram as small as about 0.0005 to 0.0010 inch can produce defective can bodies in a bodymaker. Vibration in the bodymaker as a whole contributes to wear on all moving parts and resultant loss of precision.

The Maytag patent teaches the adaptation of a straight-line motion assembly acting between the connecting rod and the ram to offset vibration or misalignment. This assembly employs a cross-head with side thrust resisting levers. In addition, the carriageway and rollers are intended to ensure the linear accuracy of ram motion. This basic arrangement and subsequent refinements of it have proven successful in producing one-piece can bodies for many years. However, the cross-head and carriageway are less than perfect in eliminating vibration or deviations from linearity. To at least some degree, the Y-axis deviations introduced in the vertical plane by a rotary crank can add vibration or misalignment to a ram. At certain levels of accuracy, the deviation may be of little importance. For example, at a specified container sidewall thickness of 0.004 inch, the inaccuracy caused by deviations may be absorbed in the acceptable tolerance from the specified sidewall thickness. However, a level of technology will be reached at which the deviations become the limiting factor that prevents further savings of costs and materials.

Efforts to improve the accuracy of the Maytag bodymaker largely have focused upon better support and centering for the ram, while continuing to employ the slider-crank mechanism. U.S. Pat. No. 4,934,167 to Grims et al. shows modifications of the Maytag bodymaker, wherein liquid or hydrostatic bearings support the ram carriage. In addition, liquid bearings carry the ram carriage on a pair of guide rods to further ensure accurate linear movement with low friction. U.S. Pat. No. 5,257,523 to Hahn et al. shows modification of the Maytag and Grims patents, using electromagnets responsive to ram position to maintain the ram in radially centered position. U.S. Pat. No. 5,335,532 to Mueller et al. shows a counterbalance structure that is reciprocated opposite to movement of the ram, with a perpendicular component, to compensate for X-axis, Y-axis and Z-axis vibration. U.S. Pat. No. 5,546,785 to Platt et al. shows a split crank that allows adjustment of the crank throw so that different crank throws can be selected to alter the ram's travel. This adjustability permits a single bodymaker to produce can bodies of different sizes. U.S. Pat. No. 5,564,300 to Mueller shows the replacement of Maytag's cross-head with a version of the Peaucellier Straight-line Mechanism that supports linear motion of the ram.

Another bodymaker design is taught in U.S. Pat. No. 4,173,138 to Main et al, which continues to employ the slider-crank mechanism. In this design, also, a rotary motor conventionally drives a crank arm on the Z-axis. Various connecting rods and arms are linked together between the crank arm and ram, but the linkage concludes with a drive rod having both a front end that is intended to move on the X-axis and a rear end that moves over an arc having both X-axis and Y-axis components, nonlinearly. The front end of the drive rod imparts X-axis driving motion to the ram. In turn, the ram is supported on two spaced-apart, stationary bearings for guiding the ram on a linear axis with precision. The various bearings on the drive rod and the ram are hydrostatic oil bearings, which have good precision aligning or self-centering properties.

The inherent problems of slider-crank mechanisms are acknowledged in U.S. Pat. No. 4,956,990 to Williams, which shows a ram reciprocated by a wobble mechanism. The disclosed ram drive mechanism reciprocates the ram on the X-axis by applying reciprocal forces to a transverse rod that is connected at its center to the ram. Opposite ends of the transverse rod each engage a different wheel of a powered, synchronized pair of counter-rotating wheels that turn on a common axis lying perpendicular to the ram in the Y-Z plane and that are positioned on opposite edges of the ram. Each end of the transverse rod engages one of the wheels at a working radius.

The operational path of the transverse rod is complex and might best be described as requiring wobble. The wheels are synchronized to bring both rod ends simultaneously to a forward position, advancing the ram, and simultaneously to a rearward position, withdrawing the ram. However, at all positions along the X-axis intermediate the forward and rearward extremes, the counter-rotating wheels cause the transverse rod to tilt or wobble in the Y-Z plane. Thus, at such intermediate positions, the rod either slightly rotates the ram or requires that its center connection to the ram have rotational pivoting ability. Also, the effective length of the rod changes between a minimum length at the forward and rearward extreme positions and a greater but varying length requirement throughout the intermediate wobbling positions. Due to these many complexities of motion, high-speed, stable operation would be difficult to achieve.

Still another design for a bodymaker with reduced lateral deflections of the ram appears in U.S. Pat. No. 5,735,165 to Schockman et al. Two side-by-side, counter rotating cranks operate in parallel to actuate a Scotch yoke assembly that linearly drives a pair of rams. The Scotch yoke is an open frame that is reciprocated along an X-axis on a pair of guideposts. In turn, the open frame linearly reciprocates the rams in unison. The cranks reciprocate the frame by providing rotary motion on a pair of Z-axes. With respect to the X-dimension only, the throws of the two cranks are engaged in slider blocks that fit snugly within the open center of the frame, such that the rotating cranks reciprocate the frame on the X-axis.

The open center of the Scotch yoke frame is elongated in the Y-dimension. Each crank throw is mounted in a slider block that is slidable in the open frame along the Y -axis. Consequently, rotation of the crank causes each crank throw in a slider block to slide freely within the center of the frame on the Y-axis, thereby expending motion along the Y-axis without introducing deflections having a Y-component to the frame. As a result, the cranks move the frame with what is intended to be only X-axis movement.

This arrangement has the disadvantage of operating at least two parallel mechanisms in synchronization. Unevenness between the two mechanisms can skew the Scotch yoke and produce binding or excessive wear. The sliding between each of the slider blocks and the frame of the Scotch yoke is substantial, covering a distance equal to the length of the ram throw. During high-speed operation, such substantial lateral sliding motion can introduce a high rate of wear, generate heat, change clearances, and introduce distortion. The free motion of the crank throws along the Y-axis produces constantly shifting drive points for powering X-axis movement, which creates a complex system of forces in which control of vibration can be difficult. These disadvantages can limit operating speed and require high maintenance of a Scotch yoke drive system in a bodymaker.

The production ability of commercial bodymakers has been limited for many years. Some manufacturers of successful bodymakers suggest that their bodymakers can achieve 400 cans per minute, more or less. In practice, sustained production speeds tend to be below this figure, perhaps closer to 350 cans per minute. These figures are believed to fairly represent the state of the art, according to the generally accepted ability of the bodymaker designs and improvements of the above patents that have achieved commercial success.

It would be desirable to produce straight-line motion in the ram of a bodymaker from a continuous rotary drive system by using a planetary gear mechanism capable of converting rotary motion of a motor or wheel to linear motion of the ram without the presence of a vertical thrust component. It would be particularly desirable to employ continuous rotary motion throughout a drive system to the driving connection with the ram, which would obviate the use of a rocking link or wobbling link between the drive system and ram. Continuous rotary systems offer optimal opportunity to achieve high-speed operation.

Further, the bearings and other low friction mechanisms for rotary systems are highly advanced, operate with precision, and have long life. Therefore, continuous rotary systems are the clear choice for high-speed, durable, and accurate machinery. It would be desirable to employ continuous rotary devices throughout the drive system of a bodymaker, converting to reciprocating linear motion only at the latest possible point in the drive system. For example, the bodymaker ram itself reciprocates on a linear, X-axis, for best operation. Ideally, the ram should be substantially the only component of the bodymaker that reciprocates, requires support of linear bearings, or requires that a substantial mass undergo periodic diametric reversal of direction.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a bodymaker drive system in which substantially all portions of the drive system are in continuous rotary motion, including a connection point for attaching a bodymaker ram to the drive system, but allowing substantially only the ram to be in reciprocating linear motion.

According to the invention, a can bodymaker is formed of a drive housing that carries a hypocycloid straight-line gear assembly. An input device provides rotary motion to power the gear assembly. An output device of the gear assembly delivers continued rotary motion in which at least one point of the output in rotary motion is a tracking point that tracks a straight line or linear path. A motor delivers the rotary input to the input device. A bodymaker ram is connected to the output device in a manner allowing pivotal motion between ram and the tracking point. Thus, the connection to the ram moves in a straight line. The bodymaker supports the ram with respect to the drive housing for axial movement on a longitudinal axis that is collinear with or at least parallel to the straight-line tracked by the tracking point.

According to another aspect of the invention, a machine frame supports the bodymaker drive system and ram. The drive system is formed of a major ring and a minor planetary ring. The minor ring is driven in rolling orbit against the inside circumference of the major ring. A crank device is connected to rotate with the planetary ring. The crank device provides a connection to a ram for driving the ram in a straight-line path that is parallel to a selected diameter of the major ring. The ram connection is offset from a centerpoint of the planetary ring by a radius of the planetary ring. The diameter of the planetary ring is one-half the diameter of the major ring, thereby establishing a straight-line path of movement for the ram connection along an axis of motion that is parallel to the selected diameter of the major ring. The ram is supported on the frame for straight-line reciprocation on an axis of motion. Optionally, the crank device carries to ram connections to engage two opposed rams that each reciprocate on an axis parallel to the selected diameter of the major ring.

According to a further aspect of the invention, a machine frame carries a rotary motor and a main shaft. The motor drives the main shaft for rotation about a central axis, such as a Z-axis. The central axis of the main shaft is concentric to a major ring gear that is in fixed position with respect to the frame. A minor planetary gear has a diameter equal to one-half the diameter of the major gear and is positioned at a lateral offset with respect to the main shaft, such as an offset in an X-Y plane. The planetary gear orbits the main shaft in rolling relationship with the inside face of the ring gear. The planetary gear carries a connecting mechanism at its radius for connection to a ram. The arrangement of the two gears moves the connecting mechanism on a hypocycloid, straight-line path that is parallel to a selected diameter of the ring gear. The frame supports the ram for straight-line movement along an X-axis that is parallel to the selected diameter, thereby driving the ram on a linear path.

According to another aspect of the can bodymaker, a drive mechanism controls operation of a rotating and orbiting shaft by synchronizing the rotating and orbiting motion such that a tracking point at a predetermined radius from the shaft tracks a straight line. A circular crank hub, which has an eccentrically located mount, is connected at the mount for synchronized rotation with the shaft. The crank hub has a centerpoint aligned with the tracking point such that the centerpoint tracks a straight line. A rotatable ring is carried on a periphery of the circular crank hub. The crank hub and ring are rotatable about the centerpoint with respect to each other, enabling the rotatable ring to remain rotationally stationary while the crank hub rotates with respect to the ring, and enabling the rotatable ring to move in substantial translation with the centerpoint along a straight line of travel. A first ram connector is mounted to the rotatable ring on a diameter that is parallel to the straight line of travel, with the result that the ram connector is moveable along a straight line with translation of the rotatable ring.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
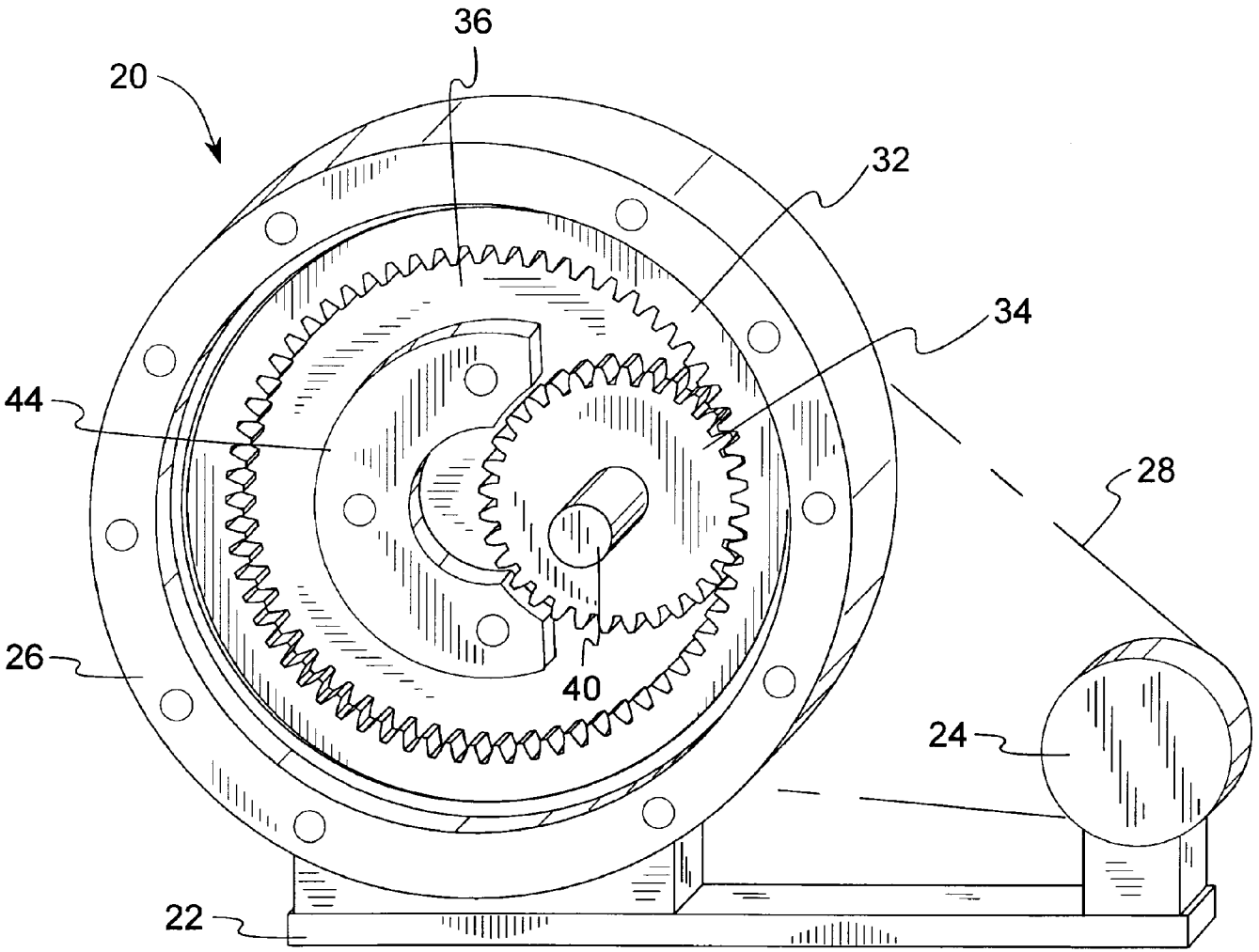
FIG. 1 is an isometric view taken from front upper right of a hypocycloid gear set in an open gearbox housing of a bodymaker drive system, positioned at the right extreme position.
Figure 2:
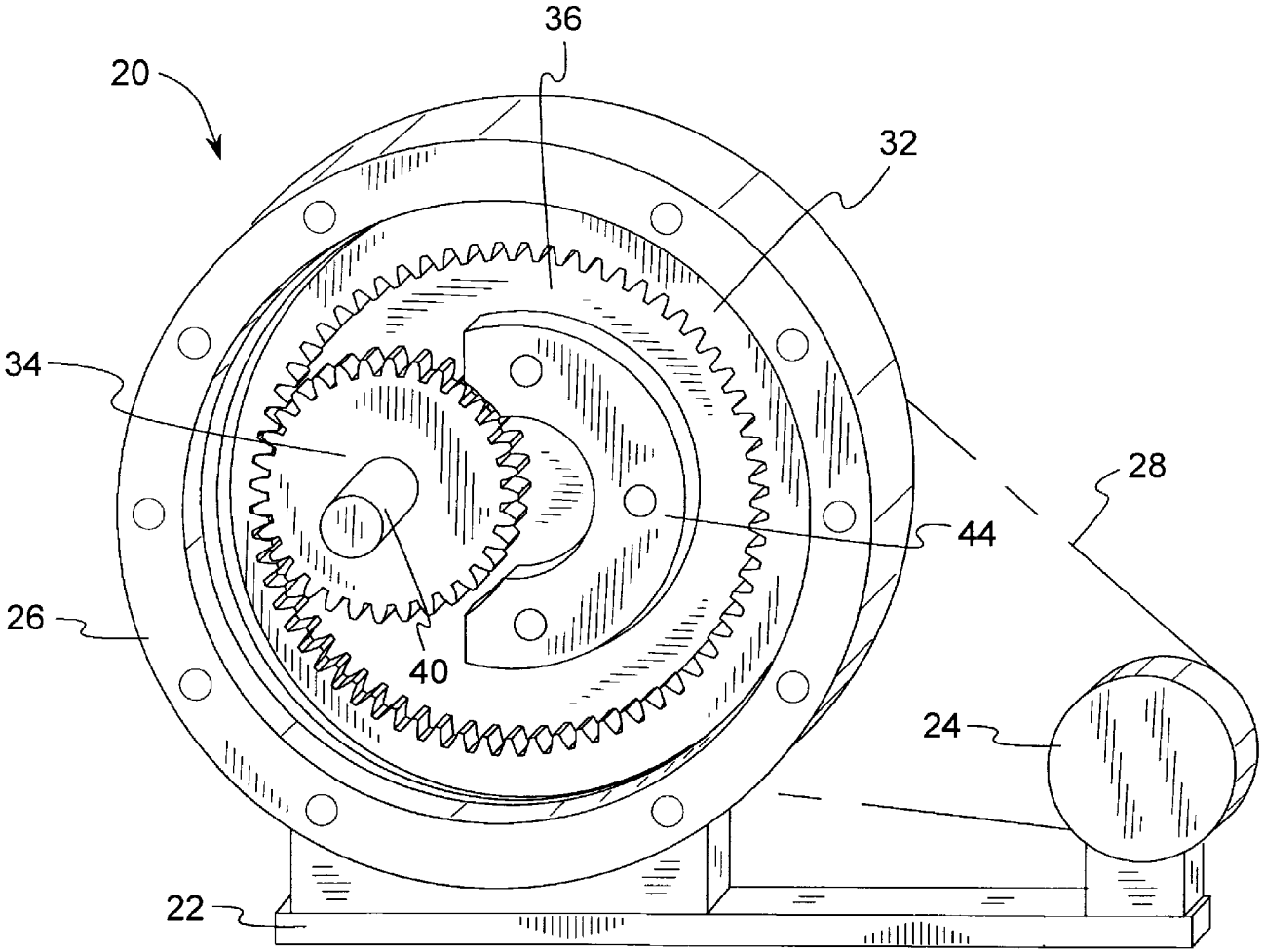
FIG. 2 is a view similar to FIG. 1, with the hypocycloid gear set positioned at the left extreme position.
Figure 13:
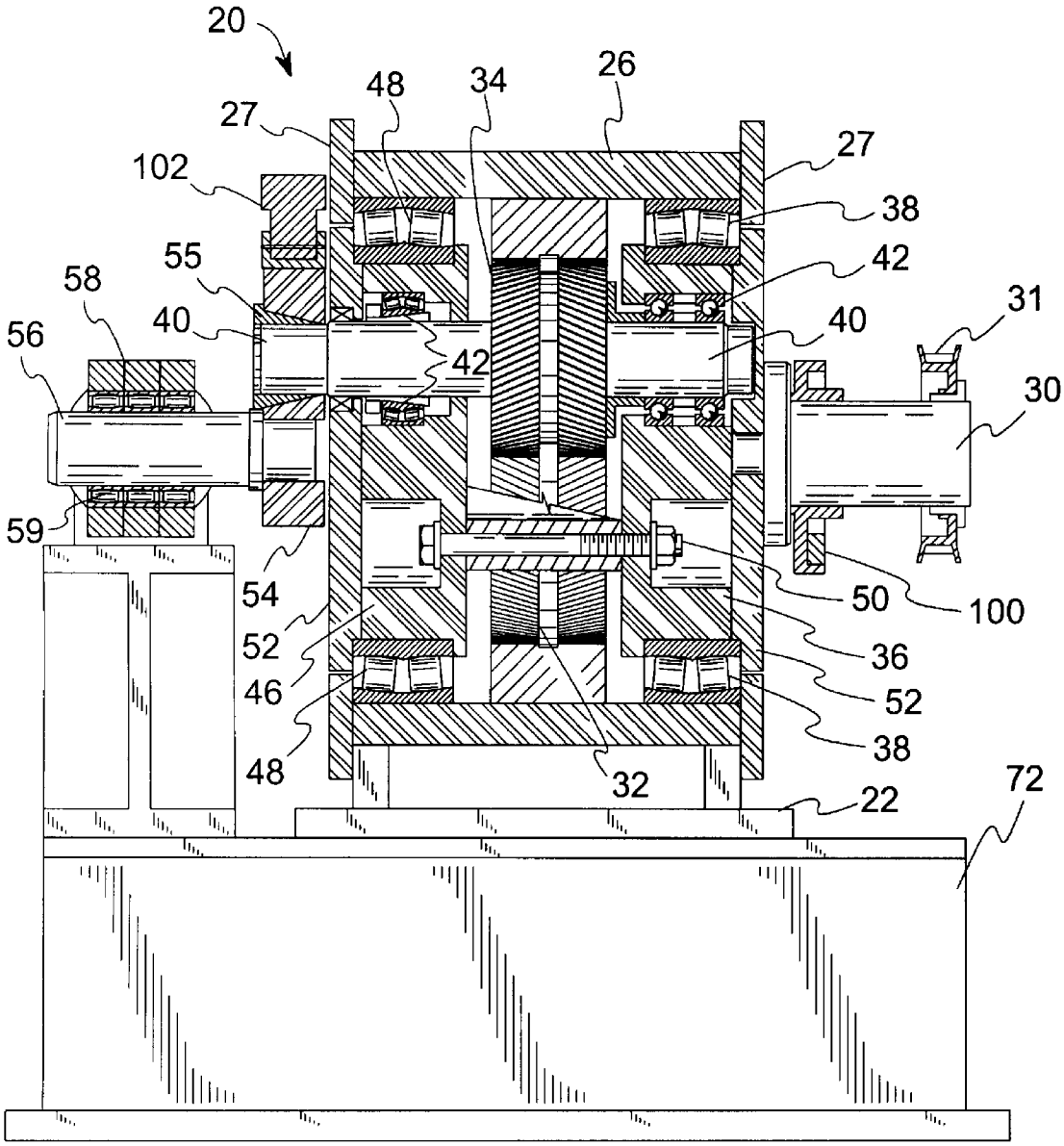
FIG. 13 is a vertical cross-sectional view of the housing of the bodymaker drive system taken approximately at the plane of line 13-13 in FIG. 10, with center spacer broken away for clarity and showing front, rear and internal shafts and planetary gear in side elevation.

With reference to the drawings and particularly to FIGS. 1, 2, and 13 the invention is a can bodymaker generally indicated by the reference character 20. The bodymaker provides a gearbox producing straight-line output to an output device for driving one or more rams along a straight-line path. Substantially all portions of the bodymaker operate in continuous rotary motion, from the motor that powers the bodymaker through the output of a rotary-to-linear converter. As a suitable example of an output device for operating the ram, a crank pin or journal pin provides connection between the rotary-to-linear converter and one or more rams. As the crank pin moves, it tracks a straight-line path, although the crank pin is located on a continuously rotating mechanism and preserves the advantages of a rotating mechanism. The one or more rams can be connected to the crank pin on bearings to establish a pivotal mounting, such that the crank pin can rotate as may be required while the rams translate on a linear path. The rotary-to-linear converter employs a hypocycloid gear train, also known as a hypocycloid straight-line mechanism.

The drive system of can bodymaker is shown to include a gearbox 20 and is built on a gearbox base or supporting frame 22. A motor 24 and a motion converter mechanism in a drive housing or gearbox housing 26 are mounted on or carried by the gearbox base frame 22. The drive housing 26 may be configured as a cylindrical shell and conveniently is configured with a cylindrical interior volume. The opposite open ends of the housing 26, which will be referred to as the front and rear faces or axial ends of the housing, are partially closed at their periphery by annular end plates or retainer plates 27. The end plates are removably fastened to the front and rear edges of housing 26, such as by bolts. As best shown in FIG. 13, the retainer plates retain of bearings within the housing. In addition, the retainer plates contain lubricant within the gearbox housing 26 and provide attachment points connecting the housing 26 to base 22.

The motor is operatively connected to provide rotary input that drives the motion converter, such as by a direct drive connection, through an intermediate system of gears and clutches, by roller chain and sprocket, by a drive belt 28, or by any other suitable interconnection. A suitable input device for delivering rotation to the motion converter is an input shaft or main shaft 30, FIG. 13, which receives power to operate the motion converter. Hence, the main shaft may carry a belt sheave or pulley wheel 31 of variably selected size to carry a drive belt 28 from the motor 24 for adjusting the drive ratio between the motor 24 and motion converter mechanism in gearbox housing 26.

FIGS. 1 and 2 show internal operating portions of the motion converter to be two interacting rollers 32, 34. The housing 26 carries the major, ring shaped roller 32 with open center of preselected inner diameter. The major ring 32 may be attached to the housing and consequently to the base frame 22 in such a way that the major ring 32 is stationary or maintains in a fixed position with respect to the housing 26 and base frame 22. The major ring 32 may be regarded as lying in an X-Y plane. The main shaft 30 operates on a main axis, which also may be called the central longitudinal axis or centerline, and which may be regarded as being a Z-axis, concentric with the center point of the major ring 32. Similarly, the major ring may be regarded as having a central axis that is collinear with the Z-axis and main axis. The gearbox housing 26 supports main shaft 30 for rotation on the main axis or Z-axis with respect to the fixed housing 26 and major ring 32.

The main shaft carries an orbitable minor roller or planetary ring 34 in suitable position to engage and roll around the inside circumference of the major ring 32. Thus, the planetary ring 34 also may be regarded as lying in an X-Y plane, where it engages the inside circumference of major ring 32, forming a hypocycloid straight-line mechanism. The planetary ring 34 operates on an axis of rotation that will be called the planetary axis. The planetary ring 34 is of preselected diameter that is one-half the preselected inside diameter of the major ring 32. As used here, the term, "diameter," refers to the effective measurement across each ring viewed as an imaginary rolling cylinder.

In the illustrated, preferred embodiment, major ring 32 is a ring gear, and orbiting ring 34 is a planetary gear. The major ring 32 us an internal ring gear, which refers to gear teeth being located on the inside face or inner circumference of the ring. The planetary gear 34 is an external gear, which refers to the gear teeth being located on the outside face of the planetary gear. The planetary gear is located within the central opening of the ring gear and has a smaller diameter than the central opening. With the gears engaged, the planetary gear can be driven to roll around the inside face of the ring gear, producing both rotational motion on the planetary axis and orbital motion as the planetary axis orbits the ring gear axis.

For purposes of description, the two rollers 32, 34 will be described as being intermeshing gears that contact one another at the inside face of the ring gear. The diameter of intermeshing gears typically is measured at the pitch circle, near the midpoint of the gear teeth. A pitch surface can be defined as the surface of the imaginary rolling cylinder that each toothed gear may be considered to replace; and the pitch circle is a right section of the pitch surface. Thus, in accordance with the definition of "diameter" given above, each gear has a pitch diameter taken across the pitch circle. The meshing of the two gears may be equated to the rolling of two cylinders in circumferential engagement, having the respective pitch diameters of the two gears. The ring gear and planetary gear have the gear ratio of 2:1. For convenience of reference, the two rollers or gears can be considered to engage at their circumferences taken at the pitch surface, where the ratio of their circumferences is 2:1.

Figure 14:
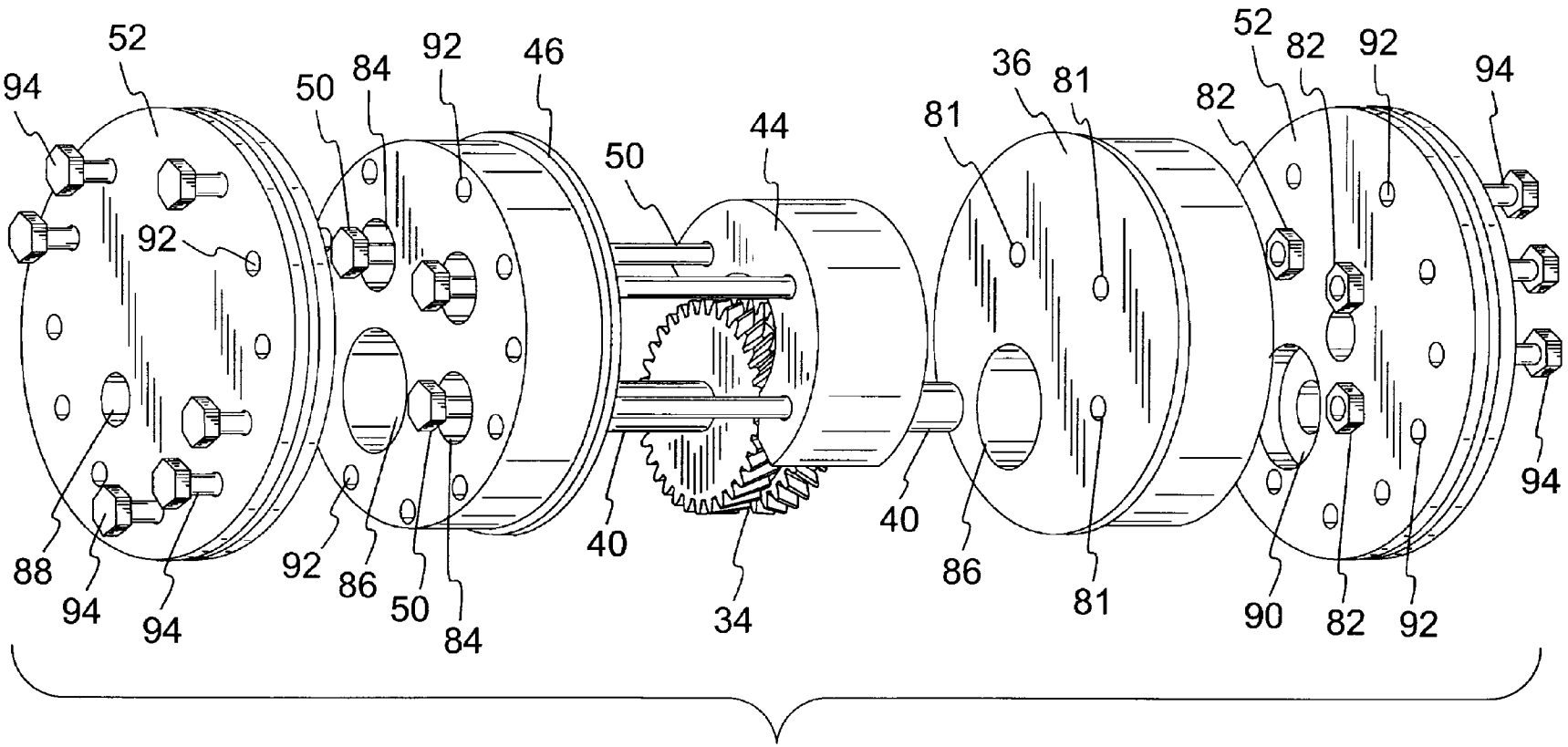
FIG. 14 is an isometric assembly view of the rotating components of a planetary gear carrier.

As best shown in FIGS. 13 and 14, a planetary gear carrier supports the planetary gear 34 with the planetary axis at a radially offset position with respect to the main axis of main shaft 30. The planetary gear carrier supports the planetary gear at least from one side, such as by a rotary support exemplified by rear hub 36. Preferably the planetary gear carrier supports the planetary gear on both sides, such as between two rotary supports exemplified by rear and front, disk shaped hubs 36, 46. At least one of the hubs 36, 46 is connected to main shaft 30, from which the hub is driven by the rotation of the main shaft 30. Each hub may rotate on the main axis. As shown in the drawings, driven hub 36 is connected to the opposite hub 46 of the planetary gear carrier and causes all hubs and other connected components of the carrier to rotate in a pre-established alignment among the two hubs and the planetary gear.

The planetary gear 34 rotates on the planetary axis, which is parallel to the main axis of the main shaft 30 and offset in a radial direction. The planetary axis also is the longitudinal centerline axis of planetary gear shaft 40, which extends from both the front and rear faces of the planetary gear 34. Rear support hub 36 receives and carries the rear portion of shaft 40 for rotation in bearings 42. The similar front hub 46 of the planetary gear carrier, further described below, carries shaft 40 on the opposite or front face of gear 34. Bearings 38 carry the rear hub 36 for rotation in gearbox housing 26.

The planetary gear can be regarded as being disposed in an X-Y plane, while the axis of shaft 40 is oriented as a Z-axis. As noted above, the shaft 40 extends from both front and rear faces of gear 34. Bearings 42 carry the shaft 40 for rotation with respect to both front and rear hubs. Shaft 40 is parallel to main shaft 30. The centerline of planetary gear shaft 40 is offset from the centerline of main shaft 30 by one-half the pitch diameter, i.e., the pitch radius, of the planetary gear 34.

As illustrated in FIG. 13, the ring gear 32 and planetary gear 34 may be herringbone or double helical gears. In order to avoid axial thrust, two helical gears of opposite hand are located side-by-side to cancel resulting thrust forces. FIGS. 1 and 2 also show a combined axial spacer and counterbalance weight 44 carried at a radially offset position from gear 34 and supported at least from rear hub 36 to cancel vibrations due to the orbiting movement of the planetary gear 34.

Comparing FIGS. 1 and 2 provides an example of the initial operation of the motion converter between two opposite configurations. Motor 24 drives the motion converter, turning rear rotary hub 36 with respect to housing 26. For purposes of example, the direction of hub rotation may be counterclockwise in the view of FIGS. 1 and 2. FIG. 1 shows the planetary gear 34 in an arbitrary starting position of rotation, which is preferred to be at a horizontal extreme position such as a right hand extreme position. Counterclockwise motion of rear hub 36 will move the planetary gear 34 through a first counterclockwise orbit or arc. A one-half rotation of the rotary hub 36 moves the planetary gear to the opposite extreme position, such as extreme left hand position in FIG. 2. Additionally, the engaged gear teeth of gears 32 and 34 have caused the planetary gear to rotate on planetary gear shaft 40. Between the positions of FIGS. 1 and 2, the planetary gear has rotated one-half revolution on shaft 40.

Continued rotation of rotary hub 36 will orbit the planetary gear around main shaft 30 through a second counterclockwise orbit or arc. The second orbit or arc of one-half revolution returns the planetary gear to the position of FIG. 1, at extreme right hand position. Thus, one complete revolution of rear rotary hub 36 moves planetary gear 34 through one orbit around main shaft 30 and ring gear 32. In completing the one orbit around the inside of the ring gear 32, the planetary gear 34 also turns one revolution on planetary gear shaft 40. The opposite extreme positions of the planetary gear 34 are illustrated in FIGS. 1 and 2 to be at horizontal extreme positions, or right hand and left hand positions. These extreme positions are reference points referred to in subsequent description of the motion converter and its operation.

FIGS. 3-7 show the motion converter in a next stage of assembly. For convenience of description, a front rotary hub 46 of the planetary gear carrier is omitted in these illustrations, which continue to expose the gear set 32, 34. In fact, as shown in FIG. 13, a completely assembled motion converter in bodymaker gearbox 20 includes a front rotary hub 46 that is carried in housing 26 for rotation on bearings 48. This front hub 46 carries a front end of the planetary gear shaft 40. The rotary hub 46 also closes the front side of gearbox housing 26. The front and rear rotary hubs are fastened together for synchronized rotation by any suitable fastening or alignment devices such as alignment pins, bolts 50, or a combination of such fasteners and alignment devices.

The gearbox housing 26 is further closed by front and rear rotary side plates or cover plates 52 that cover the front and rear rotary hubs 36, 46 at the front and rear faces of the housing 26. The cover plates may carry seals at their peripheral edges to seal against the end plates 27 of the gearbox housing 26 to contain internal lubricant. Each cover plate 52 is attached to a rear or front support hub 36 or 46 and rotates with the attached support hub. Accordingly, unless clarified in another way, reference to a first or front rotary support may refer to the front hub 46 either with or without a front cover plate 52 attached to it. Similarly, reference to a rear or second rotary support may refer to a rear hub 36 either with or without a rear cover plate 52 attached to it. Both front and rear rotary supports are rotatable with the main input shaft 30 with respect to the drive housing 26. The two rotary supports carry the planetary gear 34 between them.

FIG. 14 shows assembly of a planetary gear carrier mechanism that is the central rotary element of the bodymaker gearbox 20. Planetary gear 34 and counterweight 44 occupy a central area of this assembly. The counterweight 44 is thicker than the planetary gear 34, which permits the counterweight 44 to be clamped in place as a spacer that preserves the ability of the planetary gear 34 to rotate. Front rotary hub 46 and rear rotary hub 36 are clamped against the opposite faces of the counterweight-spacer 44. Hubs 36, 46 and counterweight 44 define aligned bores 81. Suitable fasteners such as bolts 50 pass through the aligned bores 81 of the pair of rotary hubs 36, 46 and counterweight 44. The fasteners draw together the rotary hubs against the counterweight 44. For example, the fasteners 50 may be inserted through the front hub 46 and engage nuts 82 at the rear hub 36, or fasteners 50 be threaded into the rear rotary hub. The rotary hubs 36, 46 define counter bores 84 receiving the fastener heads and nuts within the thickness of the hubs 36, 46.

The rotary hubs 36, 46 define bores 86 receiving and carrying planetary gear shaft 40 on suitable bearings. A forward end of shaft 40 extends through the front rotary support, which may include both front rotary hub 46 and front cover plate 52, to carry the crank arm 54, as subsequently described. Components of the planetary gear carrier assembly in FIG. 14 are timed to each other and the planetary gear carrier is timed to the ring gear 32. The elements of the planetary gear carrier are assembled solidly to eliminate torsional deflection between input and output sides of gearbox housing 26. The planetary gear carrier forms a solid, block-like structure that is capable of resisting strong torsional forces.

Optionally, front and rear cover plates 52 are secured to the outer faces of the front and rear hubs 36, 46 as portions of the block-like structure. The front cover plate 52 defines a through-bore 88 for passage of a front end of planetary gear shaft 40 through the front of housing 26. The rear cover plate may define a closed bore 90 for receiving a rear end of shaft 40 or providing clearance from the read end of shaft 40 in hub 36. Each cover plate 52 is secured to an outside face of the juxtaposed rotary hub 36, 46. A plurality of aligned bores 92 in cover plates 52 and hubs 36, 46 permit each cover plate 52 to be aligned with the juxtaposed rotary hub in a predetermined rotational position. Fasteners such as bolts 94 or other alignment aids such as dowel pins are inserted into bores 92 to secure the cover plates to the rotary hubs in properly aligned positions. Each bolt 94 may secure a cover plate to the outer face of a rotary hub by threaded reception in a bore 92 of the respective hub.

FIGS. 3-7 show the addition of a crank arm 54 that lies forward of the front rotary hub 46 and front cover plate 52. Crank arm 54 is mounted on the front protrusion of planetary gear shaft 40 through front cover plate 52. The crank arm 54 is attached to shaft 40 is a predetermined, aligned position with respect to planetary gear 34. The crank arm 54 may be secured to the shaft 40 by a wedge fastener 55, FIG. 13, by a laser weld, or by any other suitable means securing the crank arm in a fixed position with respect to the pitch circle of gear 34.

The crank arm 54 is an output device that rotates with shaft 40 while at least one linear tracking point of the rotating arm tracks a linear path that overlies a straight-line tracking point on a pitch diameter of the ring gear 32 or the planetary gear 34. The relative rotational position of the crank arm on shaft 40 determines the path of the line or selection of the pitch diameter that the straight-line point will track. A desirable relative orientation of the crank arm 54 on shaft 40 establishes a horizontal pitch diameter or X-axis to be tracked by the straight-line point. The presence of the straight-line tracking point on the rotary crank arm completes an entirely rotary transmission sequence, while providing at least the single point following a straight-line path. This one point allows a bodymaker ram to be attached to the crank arm 54 on a pivotal mounting such as bearings, allowing the ram to be driven with straight-line motion.

The output device may be a connecting point on the crank arm for attaching the ram. Alternatively, the output device may further include a connecting device such as a journal pin 56 that swings through an arc on a radius of the planetary gear pitch circle as the crank arm rotates with shaft 40. The output device should be configured for motion about a Z-axis through the linear tracking point, which is parallel to and offset from the Z-axis of the planetary gear. The output device is aligned with a preselected straight-line tracking point on the pitch circle of the planetary gear 34. Either a male or female output component is suitable, as the ram can be equipped with a complementary male or female element that mates or attaches to the output device along the Z-axis of the linear tracking point.

For example, a suitable output device is shown as a crank pin or journal pin 56 that extends longitudinally on a Z-axis from crank arm 54. The crank pin 56 may be fixed to the crank arm by a press-fit or other technique so that the pin 56 is in fixed position with respect to the crank arm. A central longitudinal axis of crank pin 56 passes through the linear tracking point on the crank arm 54. The central longitudinal axis of crank pin 56 is spaced from the central longitudinal axis of planetary gear shaft 40 by the pitch radius of the planetary gear 34. Thus, the central axis of crank pin 56 is aligned with a preselected fixed point on the circumference or pitch circle of planetary gear 34 and rotates in synchronization with the planetary gear. This relationship will be referred to as being aligned with a point on the pitch circle of the planetary gear. An aligned output device such as pin 56 may be carried at a Z-axis position removed from the X-Y plane of planetary gear 34. Nevertheless, the Z-axis of the output device, such as pin 56, is perpendicular to the X-Y or major plane of the planetary gear 34 and tracks the motion of a preselected straight-line tracking point on the pitch circle or circumference of planetary gear 34.

The crank pin 56 provides a means for attaching one or more rams of the bodymaker 20 at a laterally offset position from the X-Y plane of the planetary gear. The placement of the crank arm 54 in front of rotary hub 46 and front cover plate 52 enables shaft 40 to be supported in bearings on both sides of planetary gear 34 to withstand the high forces transmitted through a bodymaker ram. As viewed in FIGS. 8-13, the crank pin 56 carries a ram journal connector 58 on bearings 59. The fixed connection to the crank arm 54 allows the crank pin 56 to remain stationary with respect to the crank arm 54. The arrangement of bearings 59 allows the ram journal connection 58 to move in straight-line motion on an X-axis.

FIG. 3 again shows the planetary gear 34 in extreme right position, similar to FIG. 1. The crank arm 54 extends further in the extreme direction, to the right according to the orientation of FIG. 3. Due to the position of crank pin 56 at the pitch circle of gears 32, 34, in the extreme orientation of FIG. 3 the axis of crank pin 56 lies directly over the pitch circle of ring gear 32. The crank pin 56 overlies one end of a preselected pitch diameter of the ring gear. FIGS. 3-7 show an XYZ coordinate system in which the X-axis, X-X, overlies and is parallel to the selected pitch diameter of the ring gear. Axis X-X typically is a horizontal axis. The Y-axis, Y-Y, is perpendicular to the X-axis and typically is the vertical axis. The Z-axis can be regarded as extending perpendicular to the plane of FIG. 3. The orientation of the crank arm 54 can be described by the position of the Z-axis through crank pin 56 with respect to the Z-axis of planetary gear shaft 40.

FIGS. 4-7 show the progressive advancement of the crank pin 56 as the planetary gear 34 rolls around ring gear 32. According to FIG. 4 as compared to FIG. 3, crank arm 54 and planetary gear 34 have advanced through a counterclockwise arc or orbit of one-eighth revolution with respect to the ring gear 32. The planetary gear 34 rotates on shaft 40 in the opposite or clockwise direction. The planetary gear 34 and crank arm 54 both have rotated clockwise by one-eighth revolution with respect to shaft 40. Notably, the crank pin 56 has shifted radially toward the center point of the main shaft 30 while tracking the straight-line axis X-X.

Figure 3:
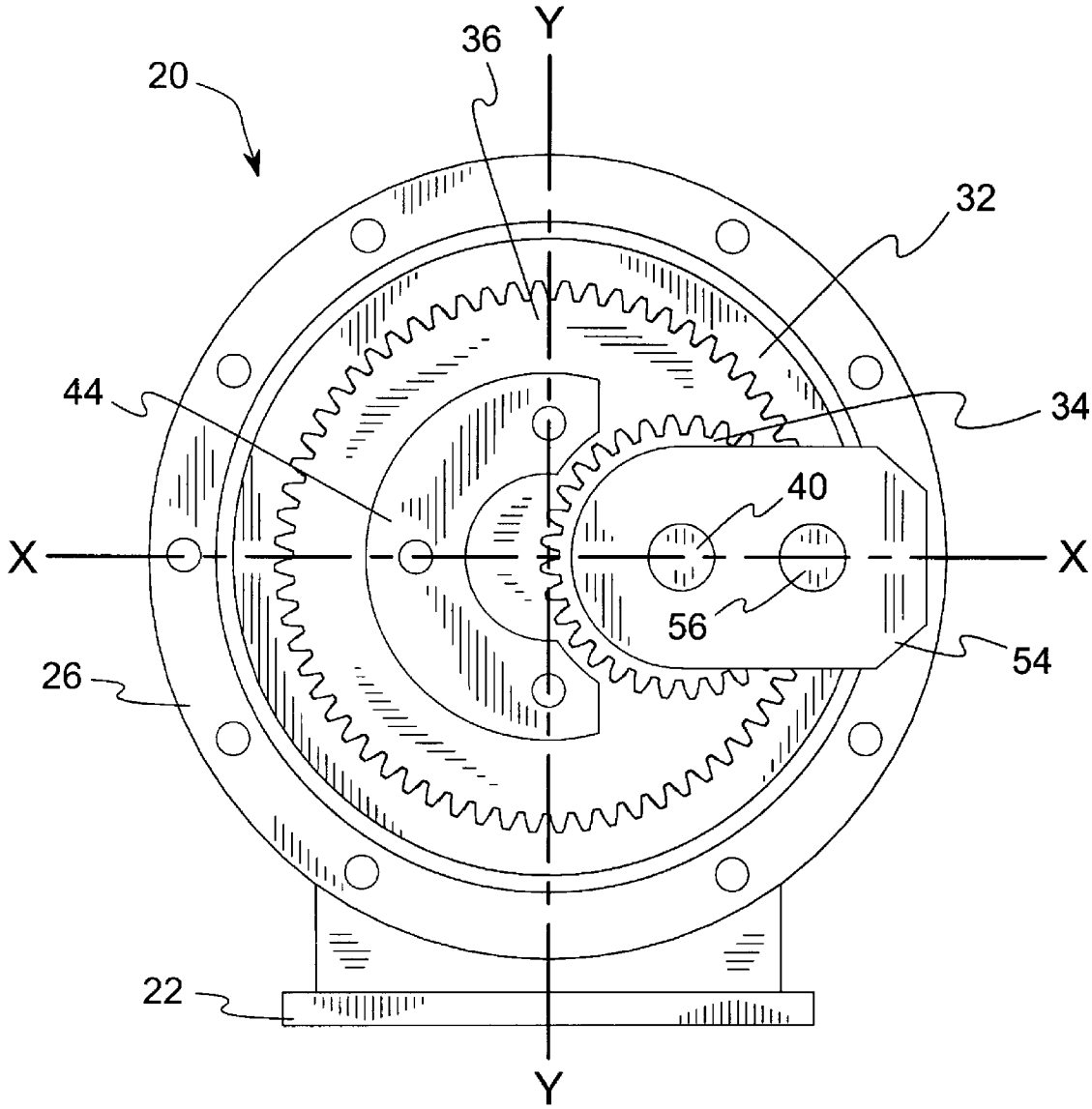
FIG. 3 is a front elevational view of the open gearbox housing and gear set of FIG. 1, with a crank arm added but omitting a front hub and front cover plate, showing right extreme position of the crank arm.
Figure 4:
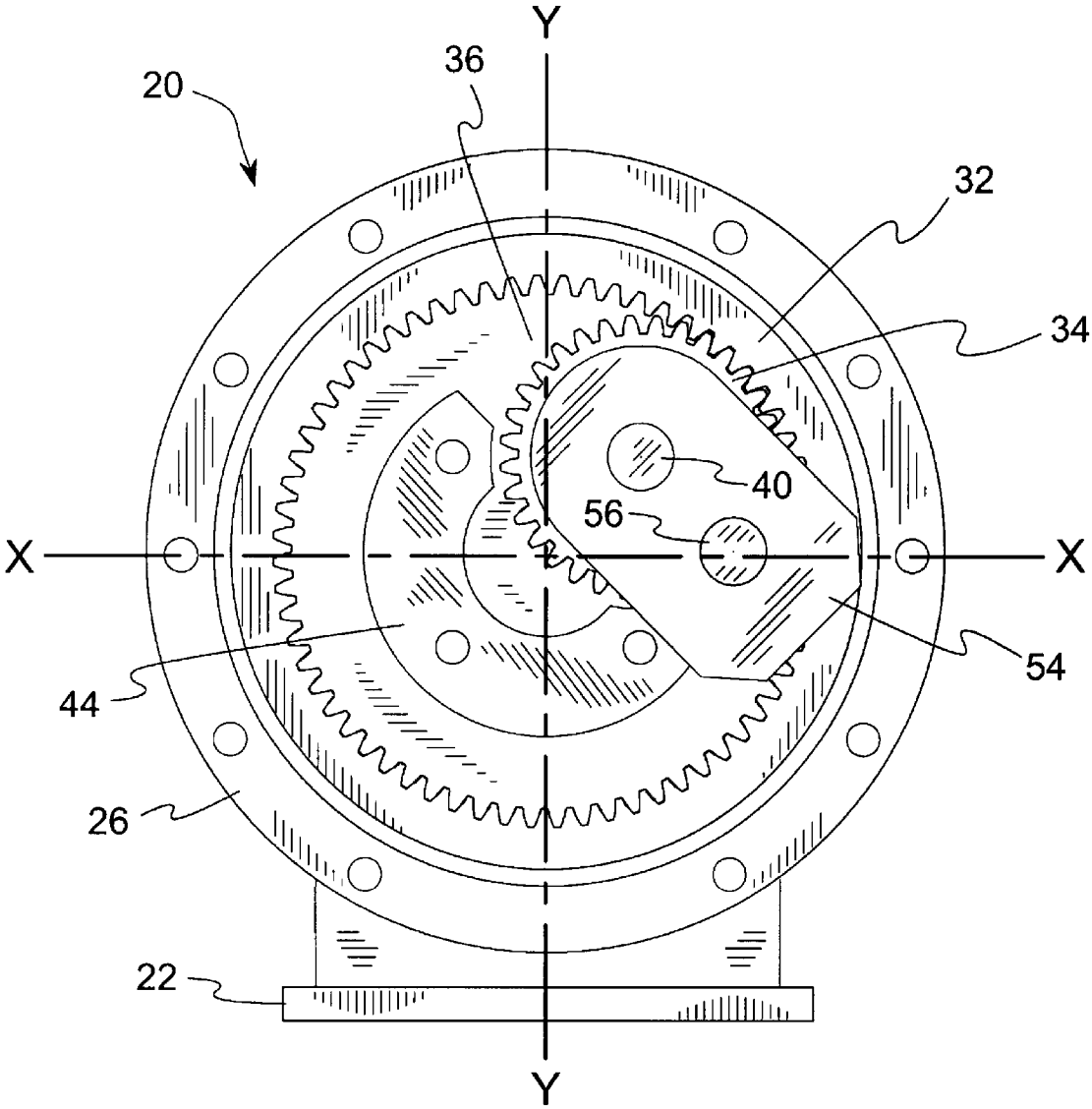
FIG. 4 is a view similar to FIG. 3, showing counterclockwise advance in the gear set and crank arm by one-eighth revolution.
Figure 5:
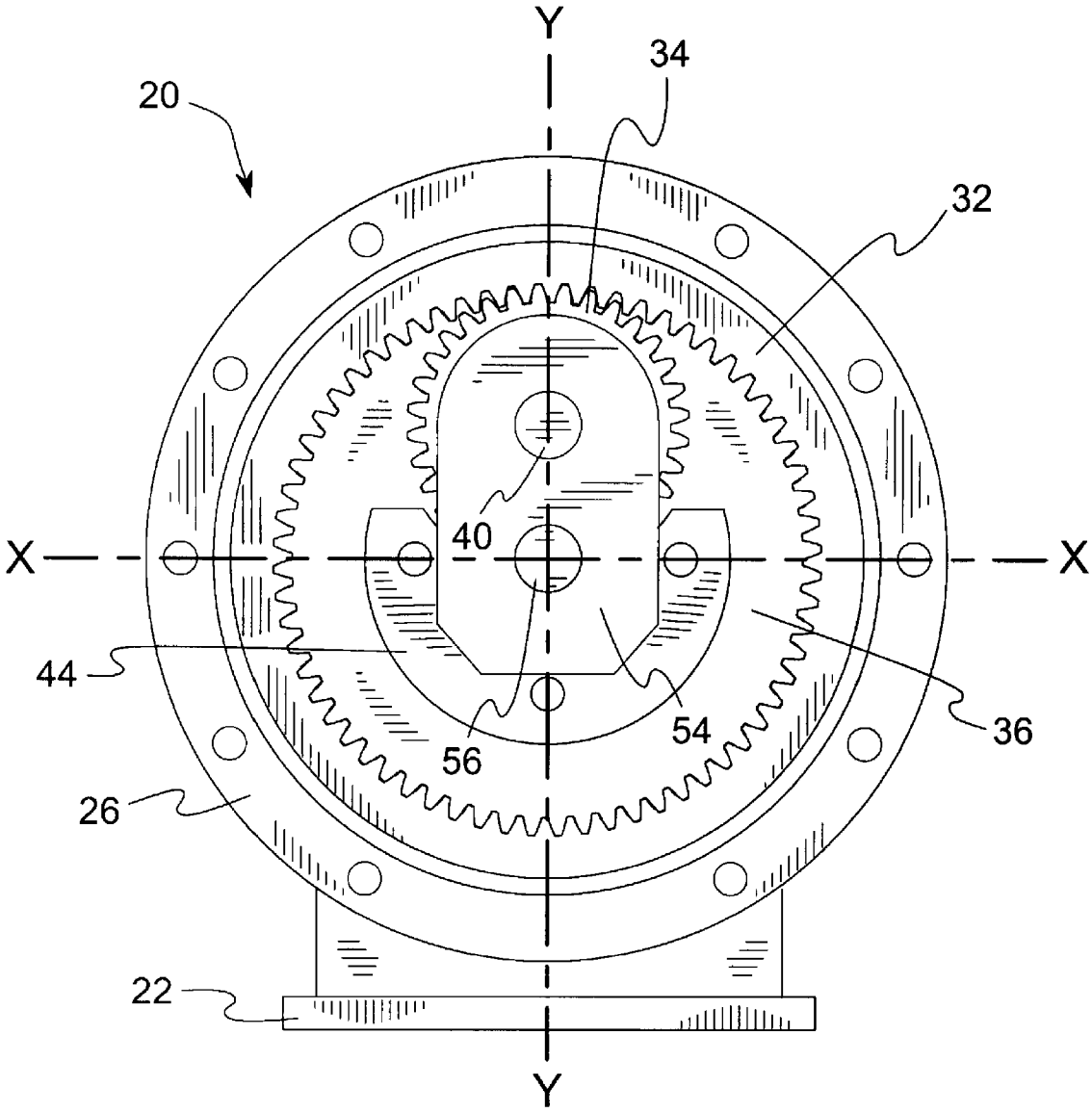
FIG. 5 is a view similar to FIG. 3, showing counterclockwise advance in the gear set and crank arm by one-quarter revolution.

Advancing to FIG. 5, the crank arm 54 has advanced by an additional one-eighth revolution for a total arc of one-quarter circle from the position of FIG. 3. FIG. 5 shows that the crank arm now is parallel to axis Y-Y. Crank pin 56 continues to track the selected pitch diameter along axis X-X and now is at the midpoint of that pitch diameter.

Figure 6:
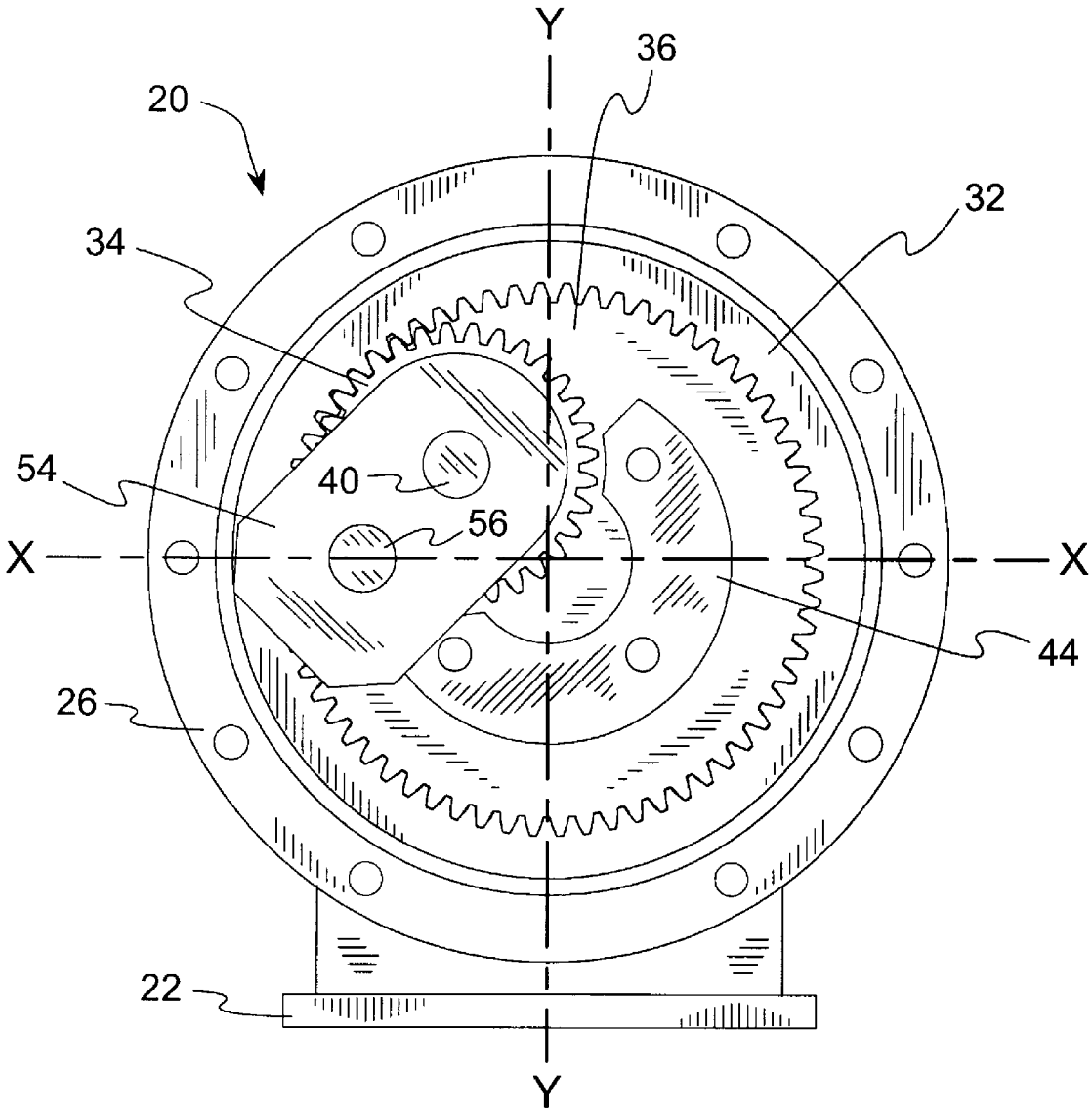
FIG. 6 is a view similar to FIG. 3, showing counterclockwise advance in the gear set and crank arm by three-eighths revolution.

FIG. 6 shows the position of the crank arm 54 after a further one-eighth revolution. The crank pin 56 continues to track the selected pitch diameter and tracks axis X-X.

Figure 7:
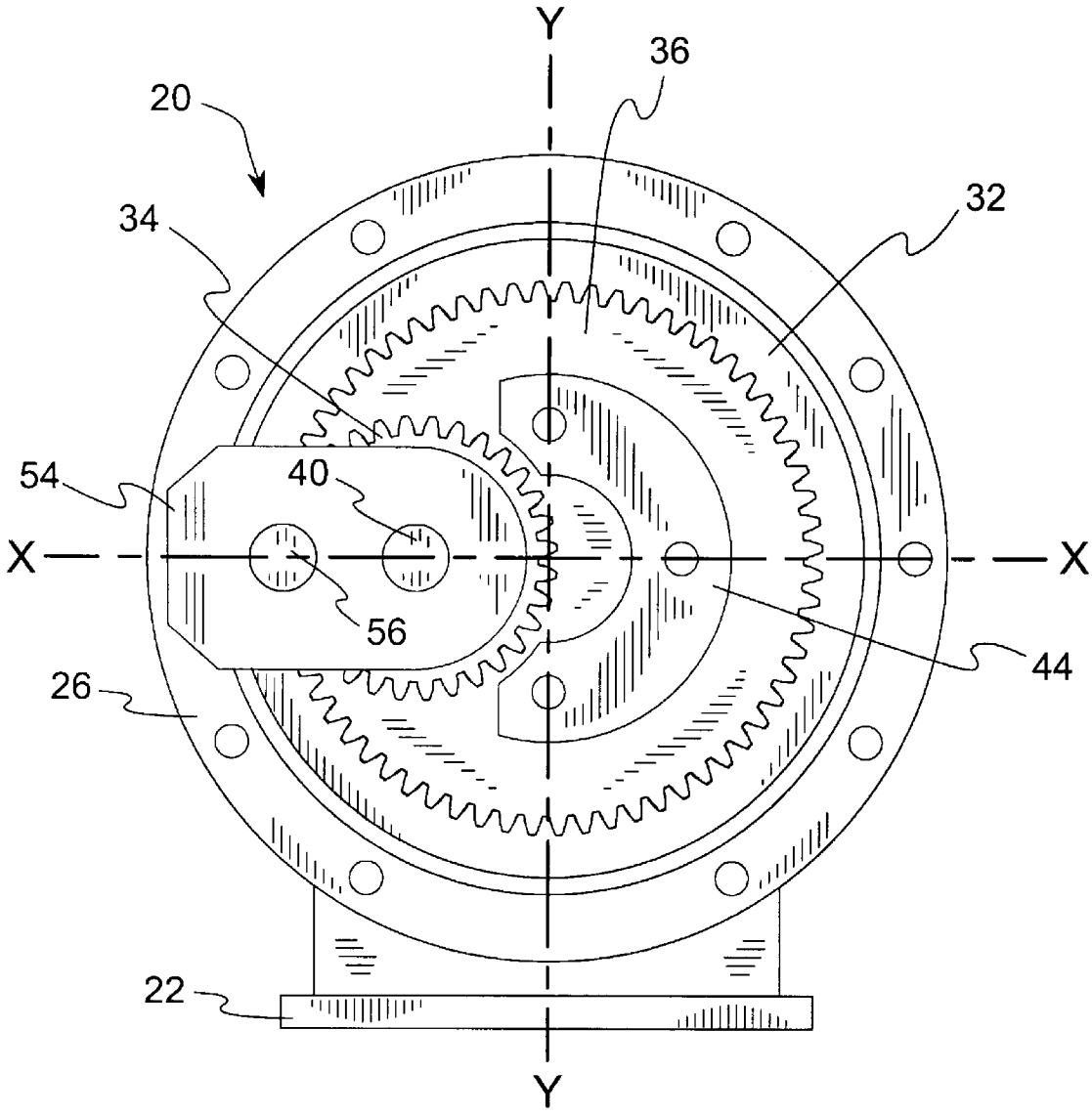
FIG. 7 is a view similar to FIG. 3, showing counterclockwise advance in the gear set and crank arm by one-half revolution, showing left extreme position.

According to FIG. 7, the crank arm 54 is shown after advancing through a total arc of one-half circle. Here the crank arm 54 extends horizontally to the left and the crank pin 56 lies over the left or opposite end of the selected pitch diameter, relative to the position of FIG. 3. Throughout the rotary motion through one-half circle, the connection means 56 followed the straight line of axis X-X. As is readily clear, the planetary gear 34 can continue through another arc of one-half circle to bring the crank arm back to the position of FIG. 3. During this further motion, the central axis of crank pin 56 will continue to track the true straight line of the selected pitch diameter, as exemplified by axis X-X. Notably, the motion of the straight-line tracking point as exemplified by a centerpoint of pin 56 in FIGS. 3-7 includes substantially no vertical or Y-axis component.

FIGS. 8-12 show the same progression of motion as in FIGS. 3-7. These figures show the bodymaker gearbox 20 with a front cover plate 52 in place. Front rotary hub 46 supports shaft 40 within the gearbox 20. Front cover plate 52 and a front end plate 27 close the front face of the bodymaker gearbox 20. Crank pin 56 is shown in its preferred embodiment to be a ram-connecting journal shaft 56 longitudinally aligned with a Z-axis that is parallel to planetary gear shaft 40 and main shaft 30. A journal box such as rotary junction 58 or other complementary structure on pin 56 mounts at least one punch or ram 60 for straight-line motion on an X-axis such as axis X-X. The elongated ram is supported with respect to a ram support base 72 in a linear bearing 62, which may be a hydrostatic bearing, magnetic bearing, or the like.

The ram is aligned with a redraw sleeve 63 and adjacent a tool pack housing 64, both schematically indicated. The redraw sleeve 63 travels along an axis that is parallel to the ram 60 and movable for longitudinal motion on an X-axis independently of the ram. The tool pack housing 64 encloses a series of ironing dies through which the ram pushes a work piece such as a preformed cup of metal, plastic, composite, polymer co-extruded laminate material, or other materials. The dies iron the preformed cup to produce a can body. The redraw mechanism 63 and tool pack 64 typically are served by a cup infeed device, schematically shown at 74, and a can discharge device and domer sub-assembly, schematically shown at 76.

Figure 8:
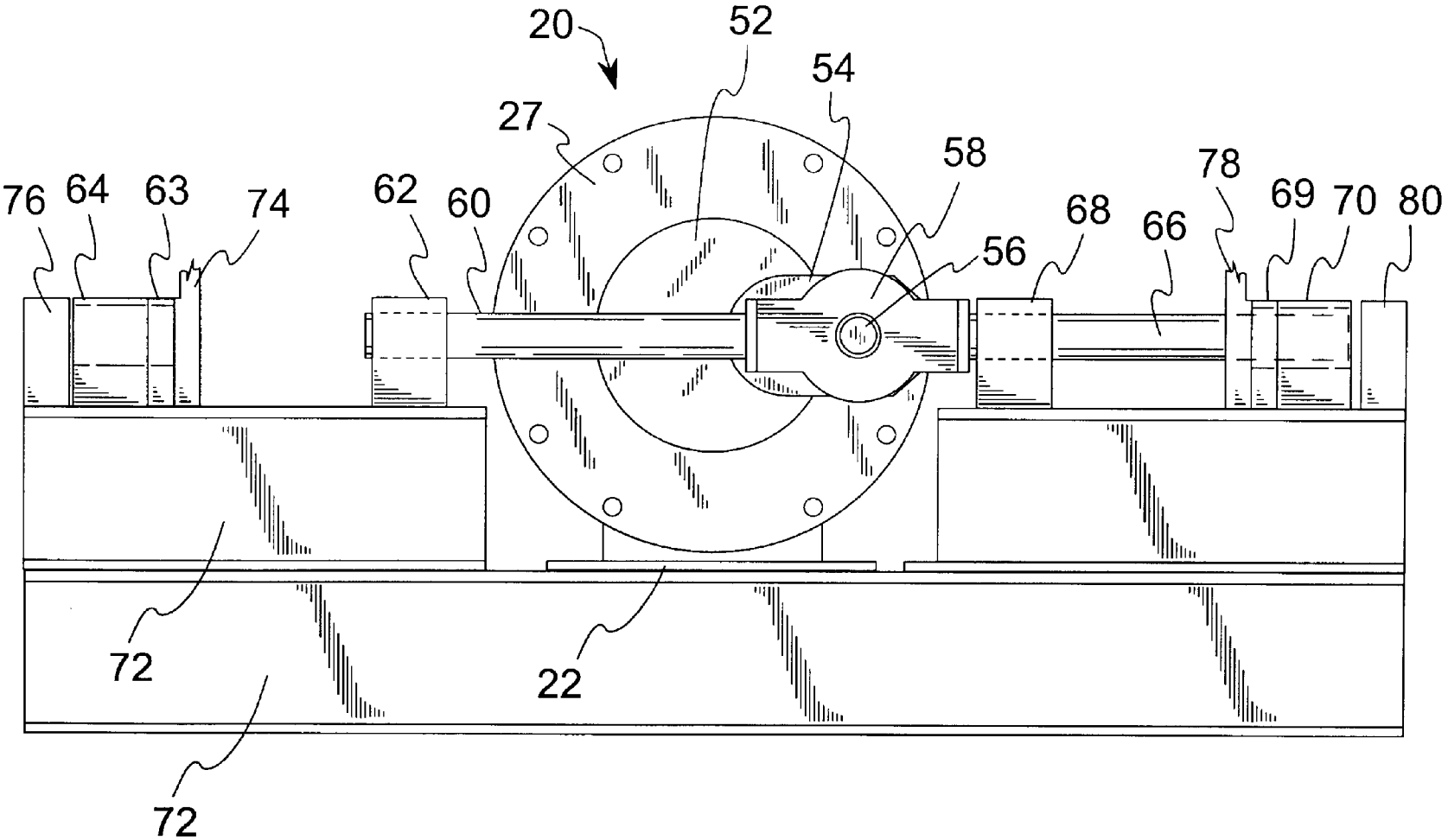
FIG. 8 is a front elevational view of a bodymaker in right extreme position similar to that shown in FIG. 3, with gearbox housing closed, and showing a dual ram system attached to the crank arm and schematically showing typical accessory equipment to the operation of each ram.

FIG. 8 shows the ram 60 in fully withdrawn position, with crank pin 56 at right extreme position. Optionally, the bodymaker 20 employs double action by powering two rams, each extending in an opposite direction. Thus, FIG. 8 also shows a fully advanced, opposite ram 66 supported in linear bearing 68, advanced through redraw sleeve 69 and tool pack 70. The redraw mechanism 69 and tool pack 70 also are served by a cup infeed device, schematically shown at 78, and a can discharge device and domer sub-assembly, schematically shown at 80.

Ram support structure 72 carries the various respective bearings, redraw sleeves, and tool packs. Ram support structure 72 also supports the gearbox 20 and motor base 22, establishing a base structure in which the gearbox, rams, and other components can be aligned as necessary for proper operation. The ram components are arranged along an X-axis in alignment with an associated ram. The two rams 60, 66 may operate either on common axis or on parallel, offset axes perpendicular to the Z-axis of crank pin 56 and parallel to an X-axis.

Figure 9:
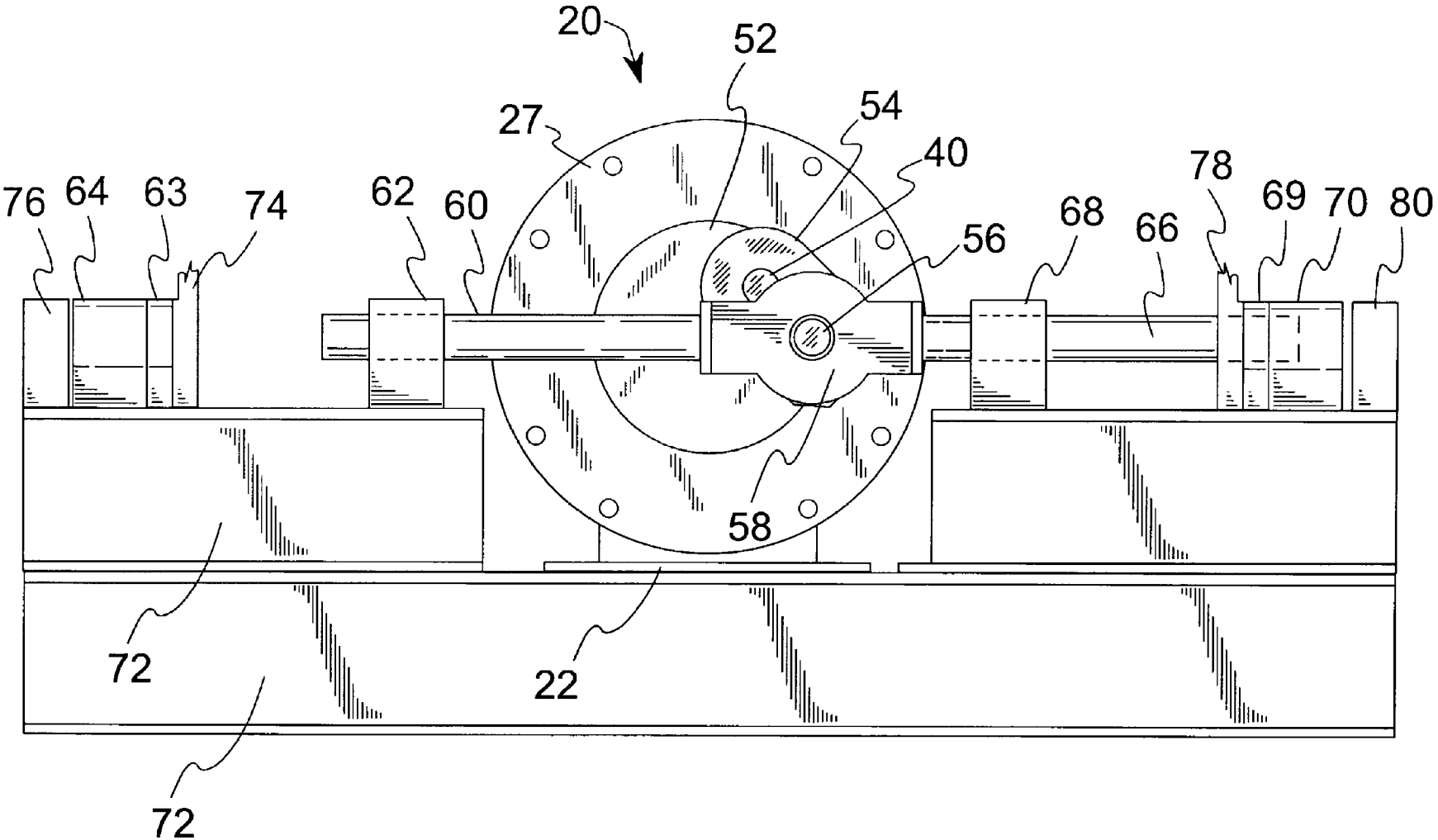
FIG. 9 is a view similar to FIG. 8, showing advance in the crank arm by one-eighth counterclockwise revolution similar to that shown in FIG. 4.
Figure 10:
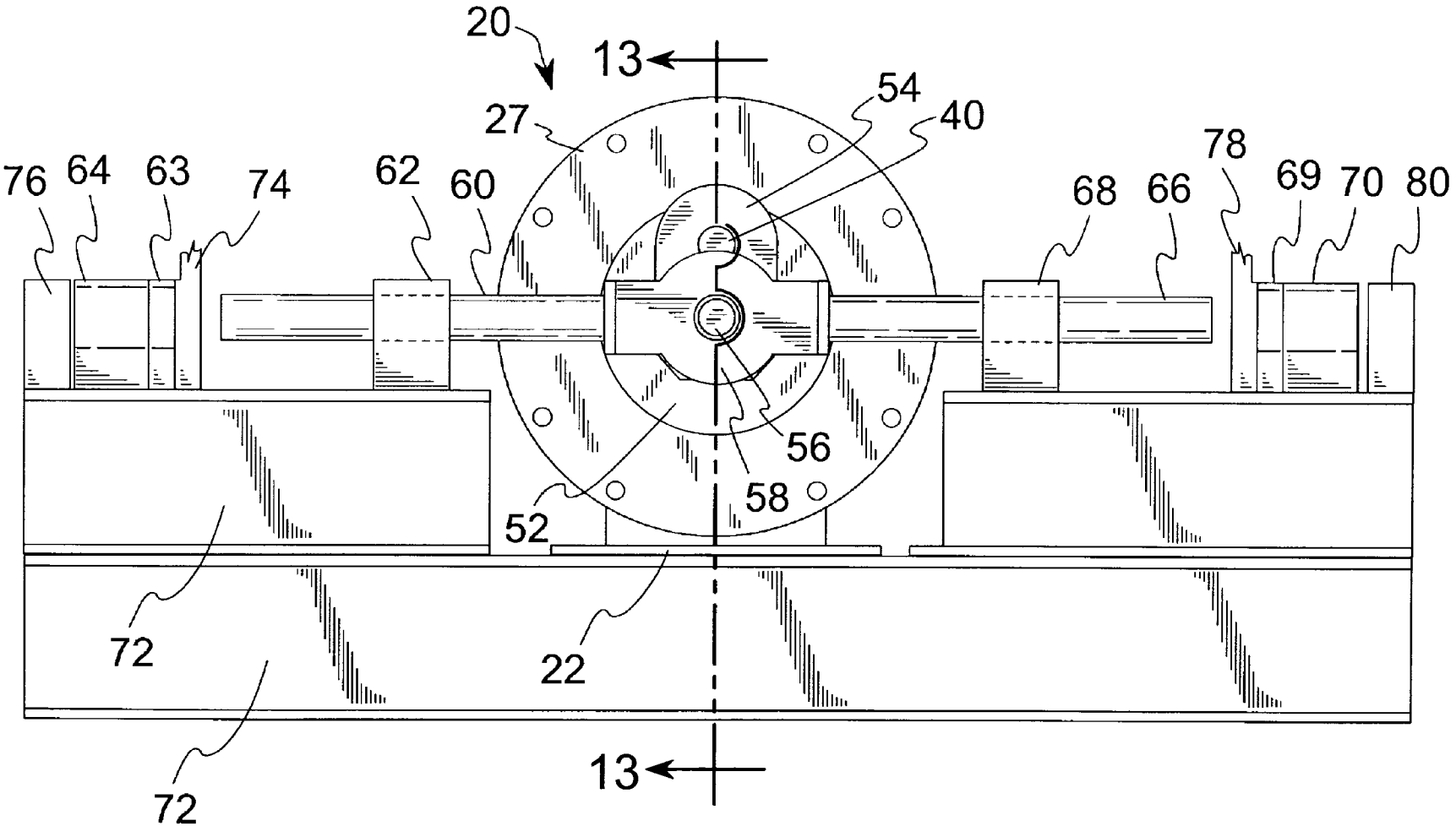
FIG. 10 is a view similar to FIG. 8, showing the crank arm advanced one-quarter counterclockwise revolution in the gear set similar to that shown in FIG. 5.
Figure 11:
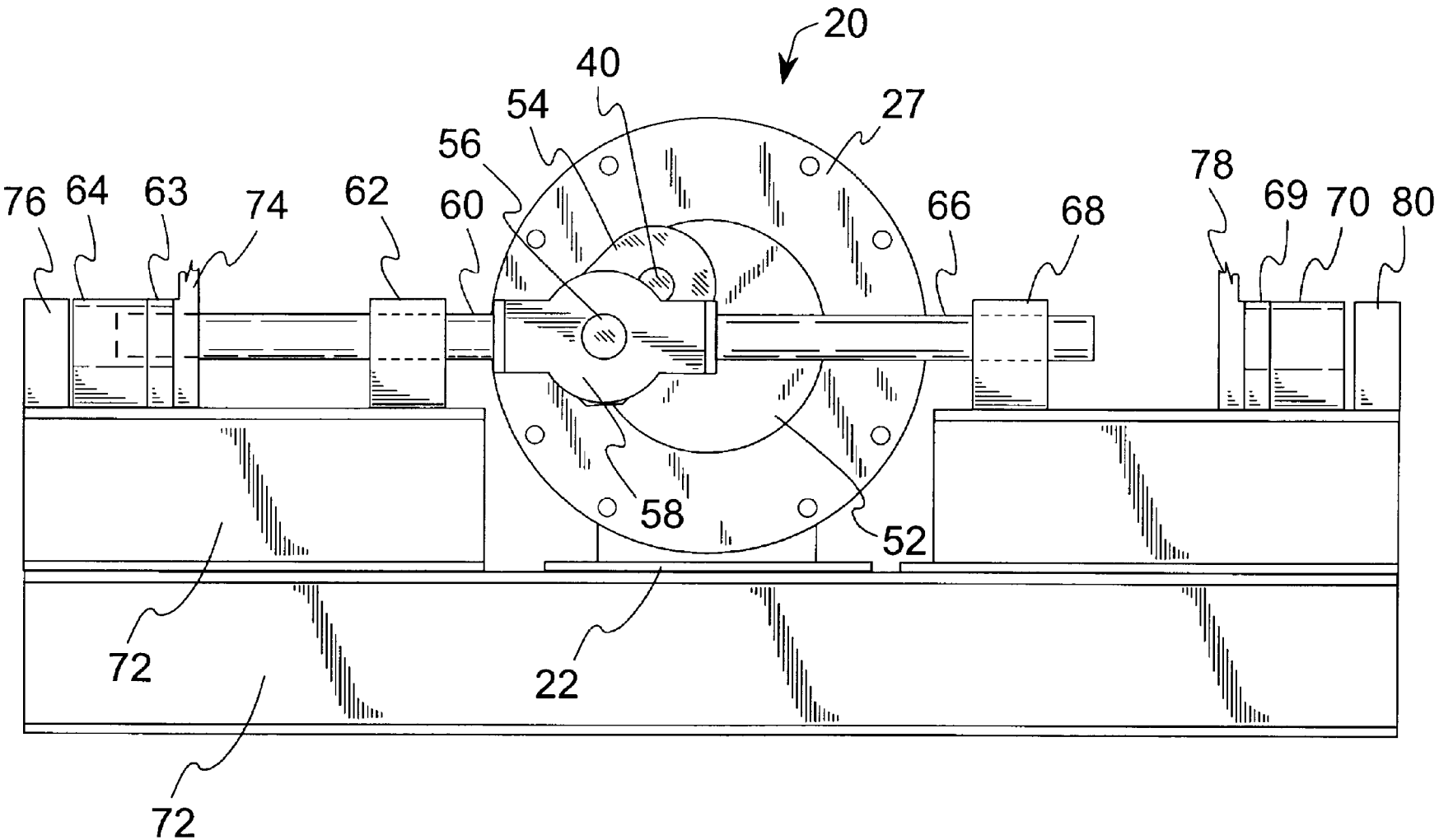
FIG. 11 is a view similar to FIG. 8, showing advance in the crank arm by three-eighths counterclockwise revolution in the gear set similar to that shown in FIG. 6.
Figure 12:
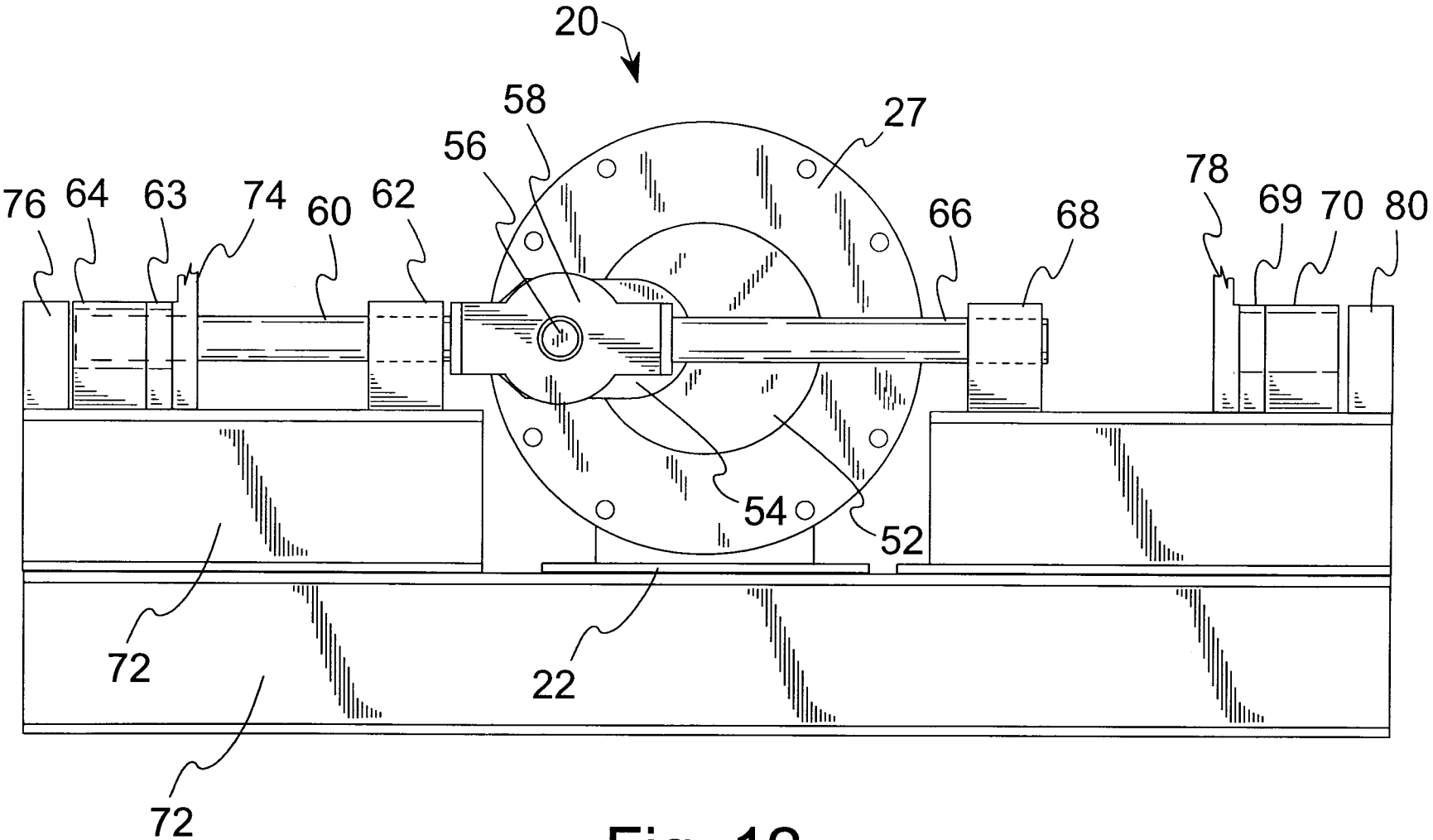
FIG. 12 is a view similar to FIG. 8, showing advance in the crank arm by one-half counterclockwise revolution in the gear set similar to that shown in FIG. 7 and showing the bodymaker in left extreme position.

FIGS. 9-12 show the two rams of a dual-action bodymaker completing one stroke each in opposite phase, with ram 60 showing the forward stroke and ram 66 showing the reverse stroke. FIG. 9 shows ram 60 advancing linearly and ram 66 withdrawing linearly as crank arm 54 turns through one-eighth revolution. In FIG. 10, the rams are at mid-stroke and the crank arm 54 is perpendicular to a longitudinal axis of each ram. FIG. 11 shows the rams moved through three-eighths of a stroke. Finally, FIG. 12 shows ram 60 at the completion of the forward stroke and ram 66 at the completion of the reverse stroke.

Figure 15:
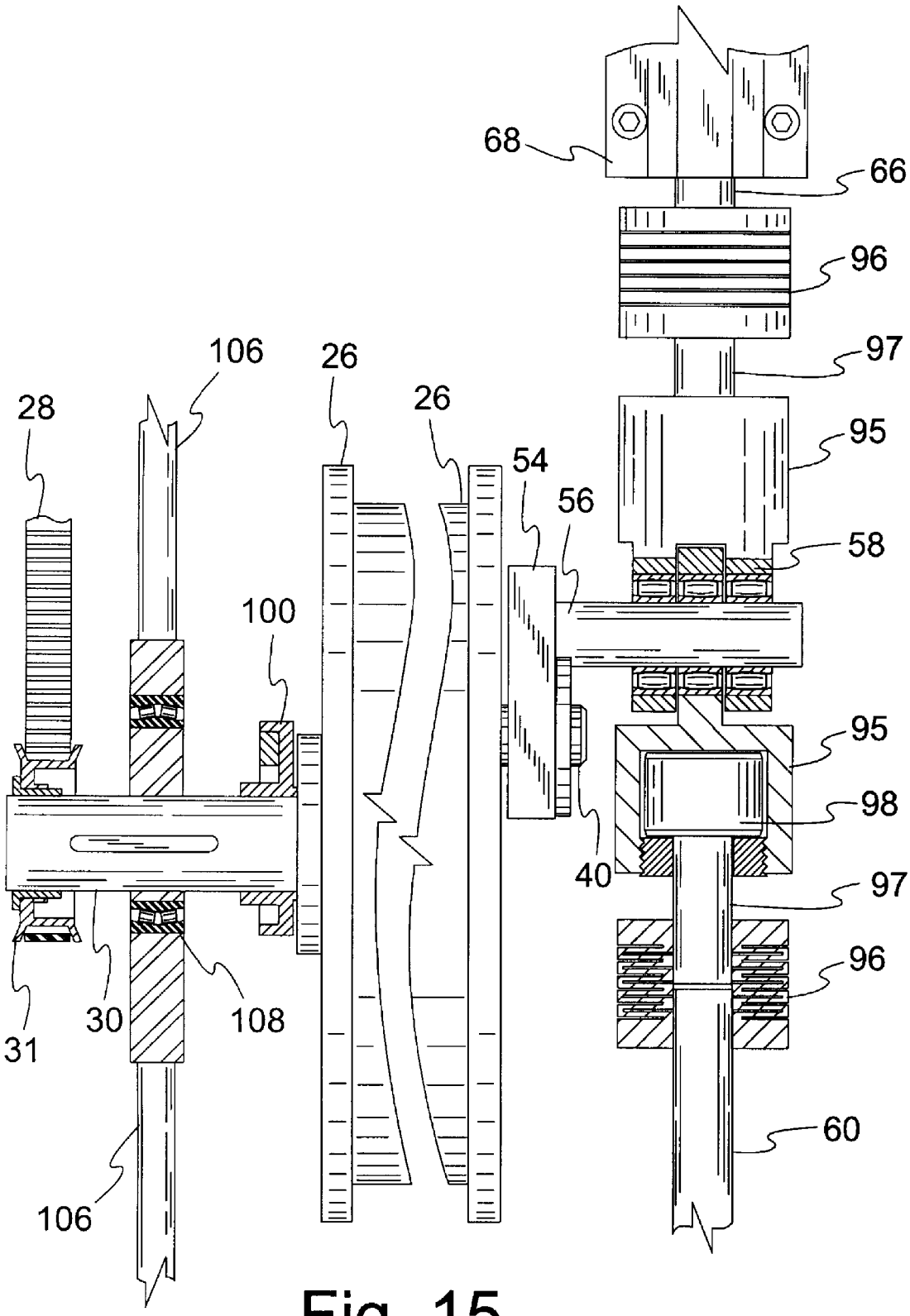
FIG. 15 is a top plan view in partial section, showing input and output mechanisms of the bodymaker gearbox housing.

FIG. 15 shows details of the input and output mechanisms of the bodymaker 20 in a partial top view of the bodymaker taken approximately from the view of FIG. 8. The input side at the left of the drawing view illustrates a drive belt 28 engaging a sheave 31 that is fixed on input shaft 30. As an option, the input shaft 30 carries an accessory operator that could be used to actuate a mechanical redraw device, if desired. The accessory operator includes an opposed pair of elongated actuator shafts 106 that are connected to an eccentric hub 108 on the input shaft 30. The eccentricity of hub 108 alternately extends and retracts each actuator shaft 106. By suitable adaptation, the actuator shafts 106 can perform any accessory function to the operation of the bodymaker.

The input shaft 30 carries a counterbalance 100, shown also in FIG. 13. This counterbalance damps vibration at the input shaft 30. FIG. 13 additionally shows a counterbalance 102 fixed to the output shaft 40 or to the crank arm 54. The counterbalance 102 preferably is a pendulum counterbalance and damps vibration at the output side of the bodymaker. Additional counterbalance devices and vibration dampers may be applied to the bodymaker as required, according to known techniques.

At the right side of the view of FIG. 15, the output shaft 40 carries crank arm 54 in fixed relationship. Journal 56 extends parallel to output shaft 40 and carries the journal connection 58 on bearings 59, as previously described in connection with FIG. 13. In order to drive the opposed rams 60, 66, the journal connections 58 provide a central journal connection to ram 60 nested between the double or forked journal connections to ram 66. Each ram is provided with an enlarged head 98 that fits closely within a holder 95. A ram stub 97 extends from each holder 95 into a bellows coupling 96. The bellows couplings 96 absorb minor parallel misalignment or angular misalignment while transmitting axial motion. The rams 60, 66 extend outward from the respective bellows couplings.

The embodiment of bodymaker gearbox 20 provides input at one face of gearbox housing 26 and output at the opposite face of the gearbox housing 26. This arrangement supports the hypocycloid drive system from one side of the ram system.

Figure 16:
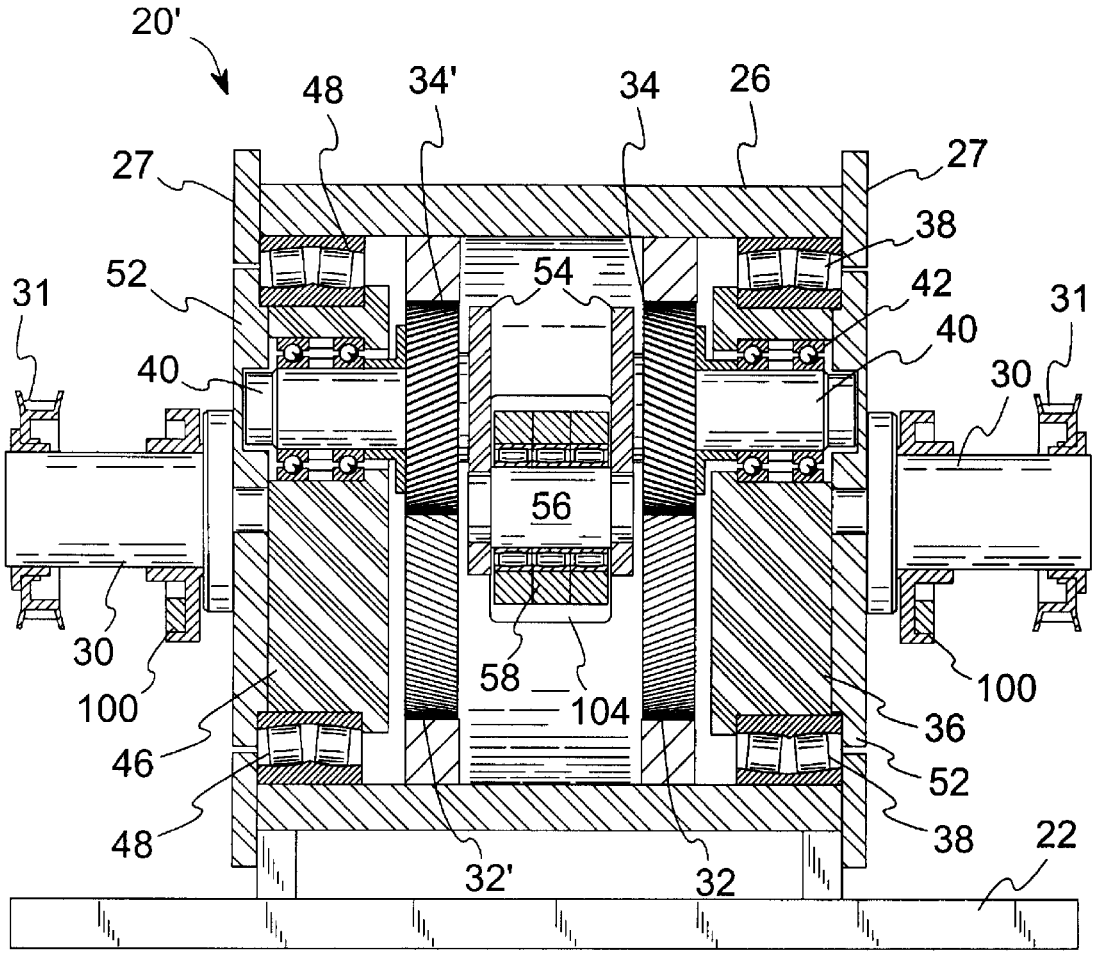
FIG. 16 is a view similar to FIG. 13, showing a modified embodiment wherein the ram output is central within the bodymaker gearbox housing.

An alternative embodiment provides input on either one or two faces of bodymaker gearbox 20', best shown in FIG. 16. Output is from a center of the gearbox housing 26. In FIG. 16, most components are given the same numbers used for the same or nearly equivalent part in FIGS. 1-15. The ring gear 32 and planetary gear 34 are shown on the right or rear side of the view, with an additional ring gear 32' and planetary gear 34' of opposite hand shown on the left or front side of the view. The front and rear planetary gears 34, 34' each carries a corresponding front or rear crank arm 54 near the center of the gearbox housing 26. A central crank pin 56 connects the front and rear crank arms 54 at the center of the housing 26 and carries the journal connections 58. Here the front and rear crank arms 54 and central crank pin 56 are joined to form a rigid connection between planetary gears 34 and 34'. The gearbox housing 26 defines passage windows 104 at ends of the preselected straight-line diameter that allow the rams to operate from the central position of crank pin 56.

Bodymaker gearbox 20' provides an input shaft 30 at either one or both faces. If driven from only one side, such as from the rear side, a rear input shaft 30 drives rear hub 36, in turn orbiting rear planetary gear 34 as similarly described in connection with FIGS. 1-15. The planetary gear 34 drives its associated rear side crank arm 54 and crank pin 56. The opposite equivalent structures, such as front crank arm 54, front planetary gear 34', and front hub 46, are driven from the rear side input through the crank pin 56. This arrangement supports the crank pin 56 from both front and rear ends.

Bodymaker gearbox 20' can be driven from both faces by applying synchronized drive systems to both the front and rear input shafts 30 of FIG. 16. If it is not desired to drive both input shafts 30, the unused input shaft 30 need not be installed.

A bodymaker gearbox 20, 20' constructed according to the invention has a potential production ability that is substantially greater than other known bodymakers. Bodymaker 20, 20' can operate with improved linear stability of the ram, enabled by the output driving force component being coaxial or concentric to the ram, itself. This will allow high-speed operation and a low rejection rate due to defective can bodies. These advantages may enable the use of less metal or other material to form each can body.

Alignment and timing have been referred to throughout. In order to produce straight-line motion through the crank pin 56 in a specific plane, the centerlines of ring gears 32, 32', planetary gears 34, 34', and crank pin 56 are initially aligned in a perpendicular plane to the desired straight-line. For example, to produce straight-line motion in a horizontal plane, the indicated centerlines are initially arranged in a vertical plane. This initial alignment is as shown in FIGS. 5 and 10, where the vertical plane is a YZ plane extending perpendicular to the view. The elements are arranged such that their centerlines lie in the same YZ plane. This initial arrangement will result in a horizontal path of displacement for crank pin 56, with a coaxial relationship with rams 60, 66. A minute amount of misalignment between the crank pin 56 and rams 60, 66 can be absorbed through the connecting members 95, 96, as mentioned above.

The description has referred to the crank arm following a linear path along a horizontal diameter or between horizontal extreme positions, such as right and left extreme positions. This particular orientation may be the commercially practical choice. However, the requirements of a particular installation may favor a differently angled axis for straight -line operations. Thus, such matters as directions of movement, angles of movement, and directions of rotation are for purposes of description and not limitation.

Throughout the description, various relative relationships have been described to include alignment, equality, ratio, concentric relationship, straight lines, parallel lines, perpendicular lines, and the like. It should be understood that normal tolerances or prudent design criteria apply to all relative relationships.

The application of a hypocycloid drive mechanism to a container bodymaker creates an opportunity to move a bodymaker ram with improved translation and significant reduction in conflicting rotary influences. The hypocycloid drive is a means for controlling operation of a rotating and orbiting shaft by synchronizing the rotating and orbiting motion such that a tracking point at a predetermined radius from the shaft tracks a straight line. As a specific example, the hypocycloid drive controls a planetary shaft 40 in both rotation and orbital motion. A tracking point on the pitch surface of the planetary gear 34 tracks a straight line.

According to a further improvement shown in FIGS. 17-25, a bodymaker 120 with gearbox 130 includes a circular crank hub 140 that has an eccentrically located mounting hub portion 144 connected for synchronized rotation with shaft 40 and has a centerpoint aligned with the tracking point on planetary gear 34 such that the centerpoint tracks a straight line. A rotatable ring 166 and circular crank hub 140 are rotatable about the centerpoint with respect to each other, enabling the rotatable ring 166 to remain rotationally stationary while the crank hub 140 rotates with respect to the ring 166. In this arrangement, the rotatable ring 166 is enabled to move in substantial translation with the centerpoint along a straight line of travel.

The described improvements and modifications provide increased accuracy in ram movement and higher speed operation, producing the bodymaker 120 shown in FIGS. 17-23. In a bodymaker producing true linear motion, even very small deflections in shaft rotation, such as of shaft 40, should be reduced or eliminated when possible to take full advantage of the bodymaker's improved capabilities. Accordingly, the bodymaker 120 of this third embodiment introduces methods and structures for stabilizing and isolating critical subassemblies. In particular, the structure and arrangement of circular crank hub 140 and ring 166 will minimize runout tolerances to produce highly accurate linear motion for the rams.

The bodymaker 120 employs numerous components that are similar to previously described components of prior embodiments. For convenience, in most instances similar components will be described by use of the previously used reference numbers.

A cylindrical gearbox housing 26 carries a hypocycloid straight-line gear assembly that receives rotational motion and converts the rotational motion to straight-line motion. An internal herringbone ring gear 32 is mounted to the gearbox housing 26. A rear retainer plate or end plate 27 is attached to the rear edge of housing 26 to partially close the rear face of housing 26. A similar front end plate 27 partially closes the front face of housing 26. The front and rear end plates 27 retain the rear and front hub bearings 38 and 48. The respective hub bearings carry a rear hub 136 and front hub 134 in housing 26. The respective hubs define a planetary shaft bore 86 that carries rear and front planetary shaft bearings 42 spaced from opposite faces of the planetary gear 34. The shaft bearings 42 carry the planetary shaft 40. The planetary gear 34, which is of external herringbone design, is mounted on the planetary shaft 40 in a position between the shaft bearings. A suitable fastener fixes the gear concentrically on the shaft for rotation with the shaft.

Side plates similar to previously described cover plates 52 are attached to the outer faces of the hubs. Seals acting between the end plates and side plates close the gearbox 130. A side plate or cover plate 52 closes the rear face of the gearbox. A modified side plate or cover plate 122, described below, closes the front face of the gearbox. Unless clarified in another way, reference to a first or front rotary support may refer to the front hub 134 either with or without front cover plate 122 attached to it. As described previously, reference to a second rotary support may refer to a second or rear hub 136 either with or without a rear cover plate 52 attached to it.

Figure 22:
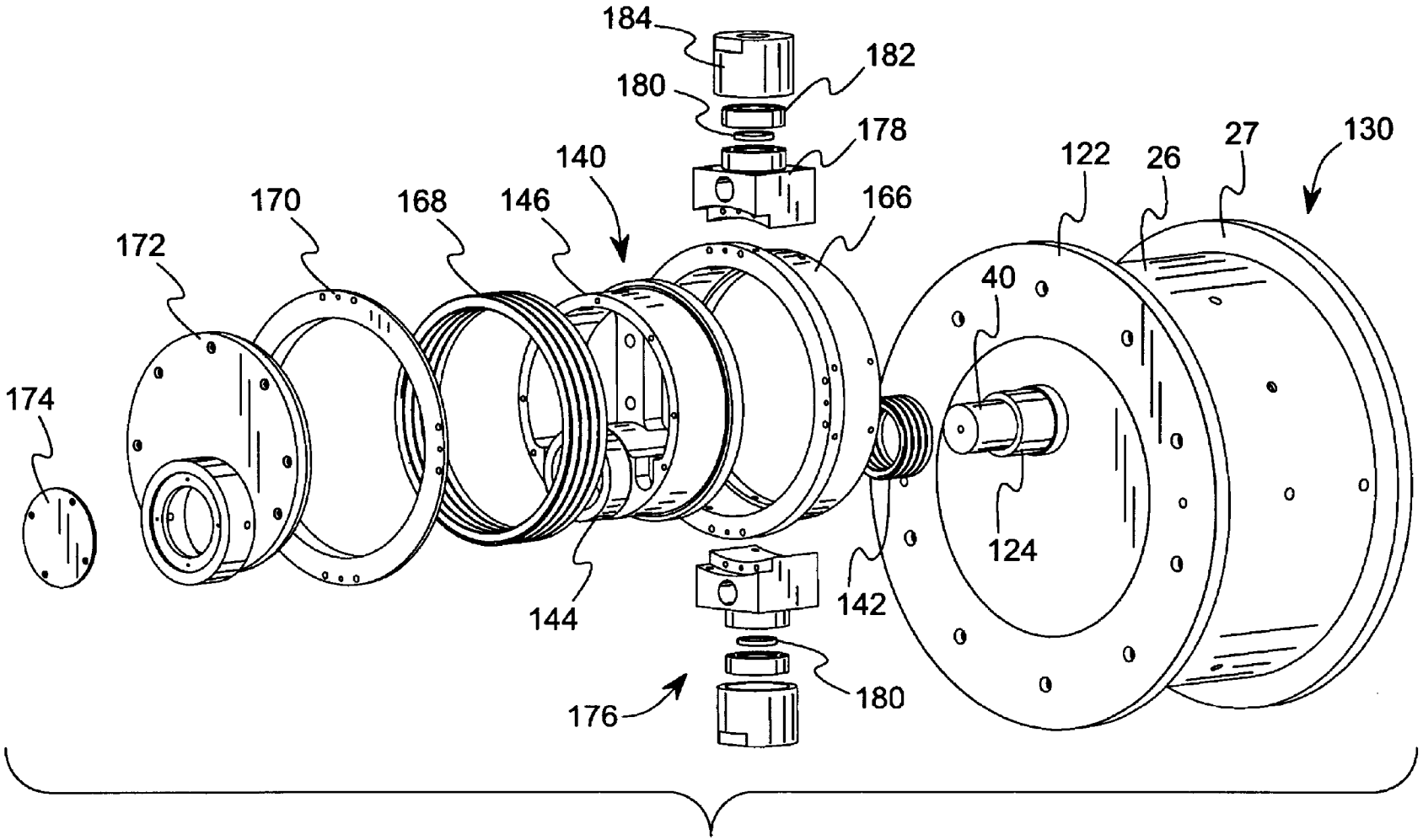
FIG. 22 is an isometric assembly view of the crank hub of the third embodiment, arranged in a six o'clock position.
Figure 23:
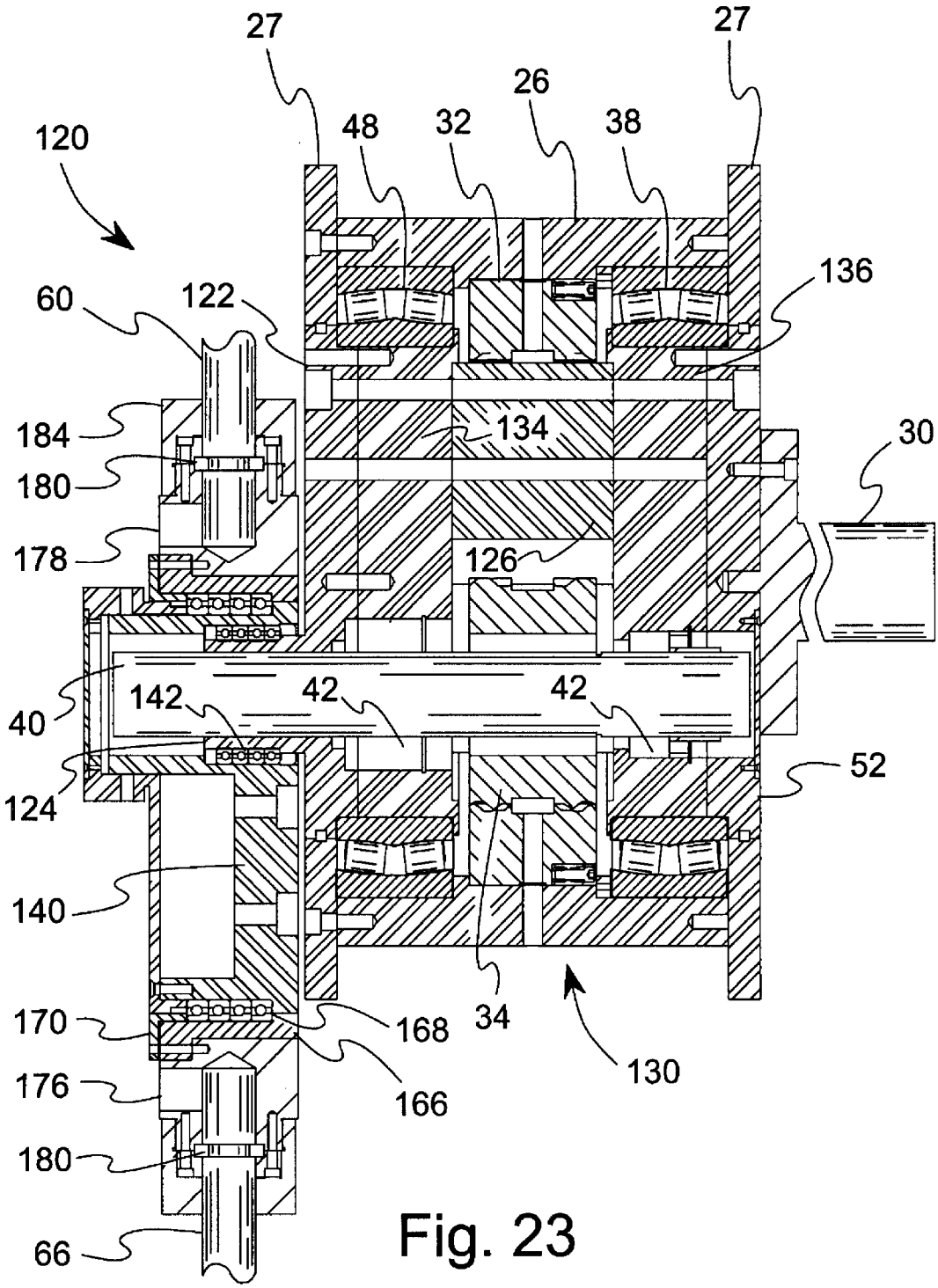
FIG. 23 is a center cross-sectional view of the third embodiment taken along the plane of lines 23-23 of FIG. 17, with end portions of the rams broken away.
Figure 24:
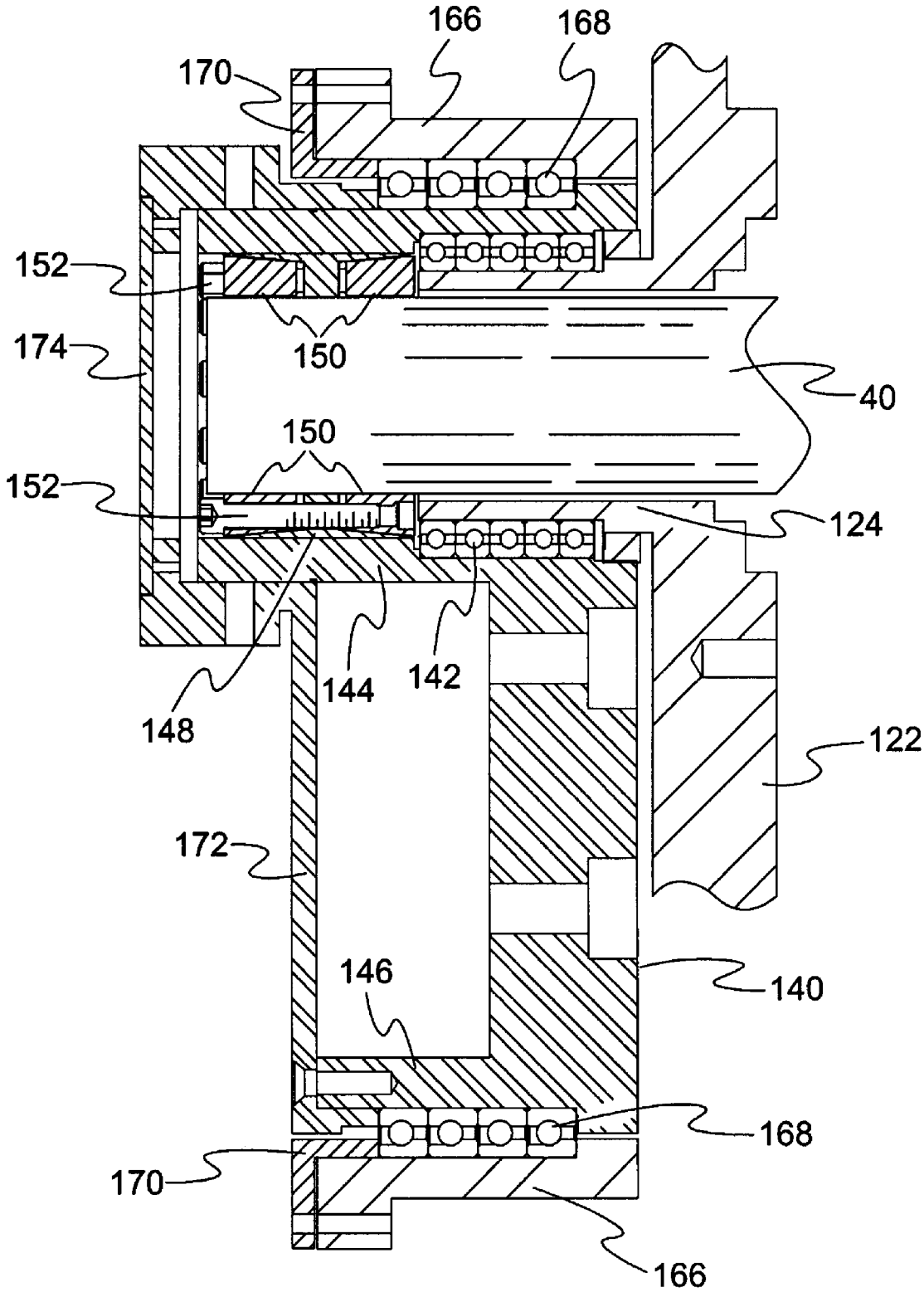
FIG. 24 is a detail view taken from FIG. 23, showing an arrangement for interconnecting the crank hub and the planetary shaft.

FIGS. 22-24 show a structure of rotating components of the bodymaker gearbox 130. In particular, a sleeve 124 extends the planetary shaft bore from the front face of the gearbox. In one arrangement, the front cover plate 122 carries the forwardly extending sleeve 124 at the bore 86 receiving the planetary shaft 40. The central bore 86 through sleeve 124 has a diameter greater than the portion of planetary shaft 40 received in the sleeve. Accordingly, the planetary shaft 40 rotates freely within sleeve 124. Bearings in housing 26, and particularly the planetary shaft bearings 42 carried in bore 86 in the front and rear hubs 134, 136 stabilize the planetary gear 34 by supporting the gear 34 from both front and rear sides on shaft 40. The forward end of the planetary gear shaft 40 extends from the forward bearing 42 through sleeve 124. Due to the support provided by bearings 42, the front end of shaft 40 rotates in bore 86 with precision and with isolation from radial forces that may be applied to gear 34. The bore 86 also extends through sleeve 124 and is precisely centered on the longitudinal centerline of planetary gear shaft 40 so that the shaft 40 rotates in a symmetrically centered position within the sleeve.

The invention contemplates that the functions of front cover plate 122 and sleeve 124 may be combined, such as in a unitary structure or in any other manner ensuring that the sleeve can bear substantial radial forces while maintaining a stable position with respect to front cover plate 122. In the embodiment of bodymaker 120, the sleeve 124 should be suitably supported to retain a clearance from shaft 40 so that the front end of the shaft carries little or no radial load. The front hub 134 and cover plate 122 are carried in coaxial alignment due to their mutual close fit into the bore of the front main bearing 48. Cover plate 122 is fastened to front hub 134 in a position precisely aligning the sleeve 124 with the centerline of the front shaft bearing 42. The front hub 134 and front cover plate 122 also may be held in exact alignment by the use of dowel pins at a suitable number of locations. The invention further contemplates suitable modifications such that sleeve 124 might be aligned with front bearing 42 by forming the sleeve as a portion of front hub 134. Regardless of whether the sleeve is mounted to the cover plate 122 or the front hub 134, the sleeve 124, front hub 134, and side plate 122 are assembled to achieve a desired high degree of alignment and high degree of stability.

Figure 21:
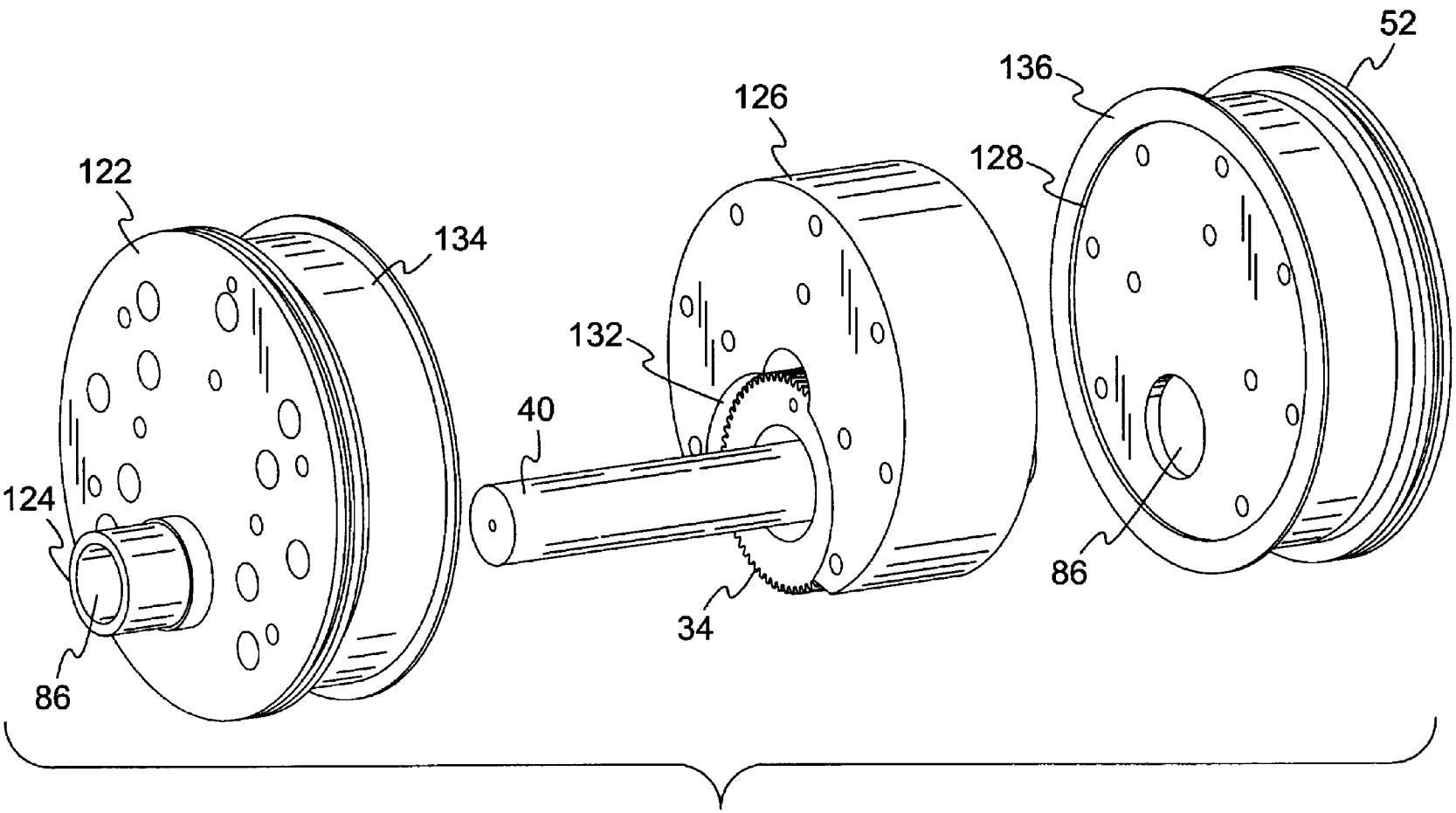
FIG. 21 is a view similar to FIG. 14, showing rotating components of the planetary gear carrier in the third embodiment of the bodymaker.

With further reference to FIG. 21, a spacer and counterweight 126 of the third embodiment provides improved stability and rigidity for all connected parts, allowing them to function together as a single, homogeneous, solidly constructed assembly. Hubs 134 and 136 of FIGS. 21 and 23 are configured to receive the spacer 126 in a nested arrangement with positional stability. The configuration of the spacer 126 provides an aspect of the positional stability. The spacer 126 is shown in FIG. 21 to almost completely encircle the planetary gear 34. The peripheral arc at the outer circumference of spacer 126 is greater than a one-half circle. In addition, the spacer 126 includes a large array of alignment holes around the peripheral arc. At an arcuate inner pocket 132 receiving the planetary gear 34, the spacer 126 extends more than half way around the planetary gear 34. The spacer 126 also nests into the juxtaposed faces of hubs 134, 136. Both hubs 134 and 136 include an annular countersink 128 on the face juxtaposed to spacer 126. The annular countersink 128 is best shown on rear hub 136 in FIG. 21. A similar countersink is present on front hub 134, facing the spacer. The pair of opposed annular countersinks 128 closely receives the spacer and secures the spacer in a fixed position against the hubs. When assembled, the side plates 122, 52, the hubs 134, 136, and the spacer 126 rotate as a unit, with precise alignment and orientation between the components and in-balance.

FIGS. 22 and 23 best show the assembled bodymaker gearbox 130 of the third embodiment with sleeve 124 extending outside the front of drive housing 26. The shaft 40 extends outside the front of sleeve 124. The outer surface of sleeve 124 supports the crank hub 140 for rotation thereon. For example, crank hub bearings 142 on the outer surface of the sleeve 124 support the crank hub 140 for rotation on the sleeve 124. Accordingly, the crank hub 140 fits over the sleeve at least in part. The fit may be larger than the size of the sleeve in order to accommodate bearings 142 or other any other type of antifriction device between the crank hub and sleeve, as appropriate. Supporting the crank hub 140 on sleeve 124 rather than directly on shaft 40 provides improved accuracy and rigidity in positioning the ram, eliminating any bending forces acting on shaft 40. Accordingly, a connection between shaft 40 and the crank hub is designed to transmit rotation between the shaft 40 and the crank hub 140, while the sleeve 124 supports the crank hub against radial forces from the rams.

The crank hub 140 is formed of two functional portions, which include a smaller mounting hub portion 144 and a larger driving hub portion 146 combined in an eccentric arrangement wherein the mounting hub portion 144 has a mounting bore located inside the periphery of the driving hub portion 146. The mounting hub portion 144 is centered on the planetary gear shaft 40 and is connected to rotate coaxially to the planetary gear shaft axis. A circular or annular surface defines the driving hub portion 146. The annular surface is located with respect to the centerpoint of the mounting hub portion 144 such that the centerpoint of the driving hub portion is spaced at the pitch radius of the planetary gear 34. More specifically, as previously described, a point at the pitch surface of the planetary gear 34 is selected to define a desired straight-line path. The centerpoint of the annular driving hub portion 146 is arranged to overlie the preselected straight-line point. As a result, the centerpoint of the driving hub portion 146 tracks a linear path that is parallel to the straight-line path of the selected point on the pitch surface of planetary gear 34.

The mounting hub portion 144 rides smoothly on bearings 142, allowing the crank hub 140 to rotate on and around sleeve 124. Due to the eccentric positioning of the mounting hub portion 144 with respect to the concentric center of the driving hub portion 146, the driving hub portion 146 extends beyond the mounting hub portion 144 by a substantial distance on the diameter of the mounting hub portion 146 extending radially through the centerpoints of both hub portions. This eccentric positioning of the mounting hub portion 144 within the driving hub portion 146 allows the driving hub portion 146 to function as a crank arm. Thus, the crank hub 140 is configured as a circular crank arm with an axis of rotation at the centerpoint of mounting hub portion 144 offset from the centerpoint of the driving hub portion 146.

In one arrangement, the mounting hub portion 144 is near the annular surface of the driving hub portion 146. The periphery of the mounting hub portion 144 blends with the periphery of the driving hub portion 146 such that the two hub portions could be described as having approximate vertex contact. This arrangement represents a desirable size of the driving hub portion 146. Altering the diameter of the driving hub portion 146 would correspondingly alter the distance by which the driving hub portion 146 extends beyond the mounting hub portion 144 on the diameter through the centerlines of the two hub portions. The diameters of the two hub portions may be chosen for mounting hub portion 144 to transmit maximum torque with a minimum diameter of driving hub portion 146.

Various means may suitably interconnect planetary shaft 40 and crank hub 140 for transmitting the rotary motion of shaft 40 to the crank hub 140. The front end of shaft 40 in sleeve 124 acts as a stub shaft that is supported in bearings 42 located to the rear of the shaft 40. Whatever interconnecting means is employed should not cause or increase deflection at the front end of shaft 40. Consequently, the interconnecting means should be selected with consideration for preserving the rotational accuracy of shaft 40.

FIG. 24 shows a type of keyless fastener that is suited to interconnect the planetary shaft 40 and the crank hub 140. The selected fastener can be a Ringfeder shrink disc locking assembly, which is a type of locking device that can be used in lieu of a keyway to concentrically attach mounting hubs to shafts. Such fasteners create radial pressure and can be applied either between a hub and shaft to create expansive pressure between them, or over a hub on a shaft to create compressive pressure squeezing the hub against the shaft.

As used in the embodiment of FIG. 24, a shrink disc 148 fits snugly inside the bore of mounting hub portion 144, between the mounting hub bore wall and the front portion of the planetary shaft 40. The gap in front of sleeve 124 receives the shrink disc while in uncompressed condition. The inner face of the disc 148 faces toward the planetary shaft 40 and is configured with a double taper design using two inclined planes or tapers—a front taper and a rear taper. The front taper extends from the center of the disc width toward the front end of the disc, and the rear taper extends from the center of the disc width toward the rear end of the disc. A pair of clamping rings 150, which will be referred to a front and rear rings, are slightly smaller than disc 148 and each has a tapered outer face that fits against either the front or rear taper of the disc 148. The front and rear clamping rings are fit against the respective tapers on the disc 148. Locking screws 152 extend through the front taper ring 150 and thread into the rear taper ring 150. Tightening the locking screws 152 draws the clamping rings 150 toward each other somewhat like a screw clamp. However, the clamping rings also are climbing the opposite tapers of disc 148, forcing the clamping rings against shaft 40. Suitably torqued locking screws 152 produce radial contact pressure between shaft 40 and mounting hub 144. The result is a mechanical shrink fit connection operative between shaft 40 and hub 144.

Figure 25:
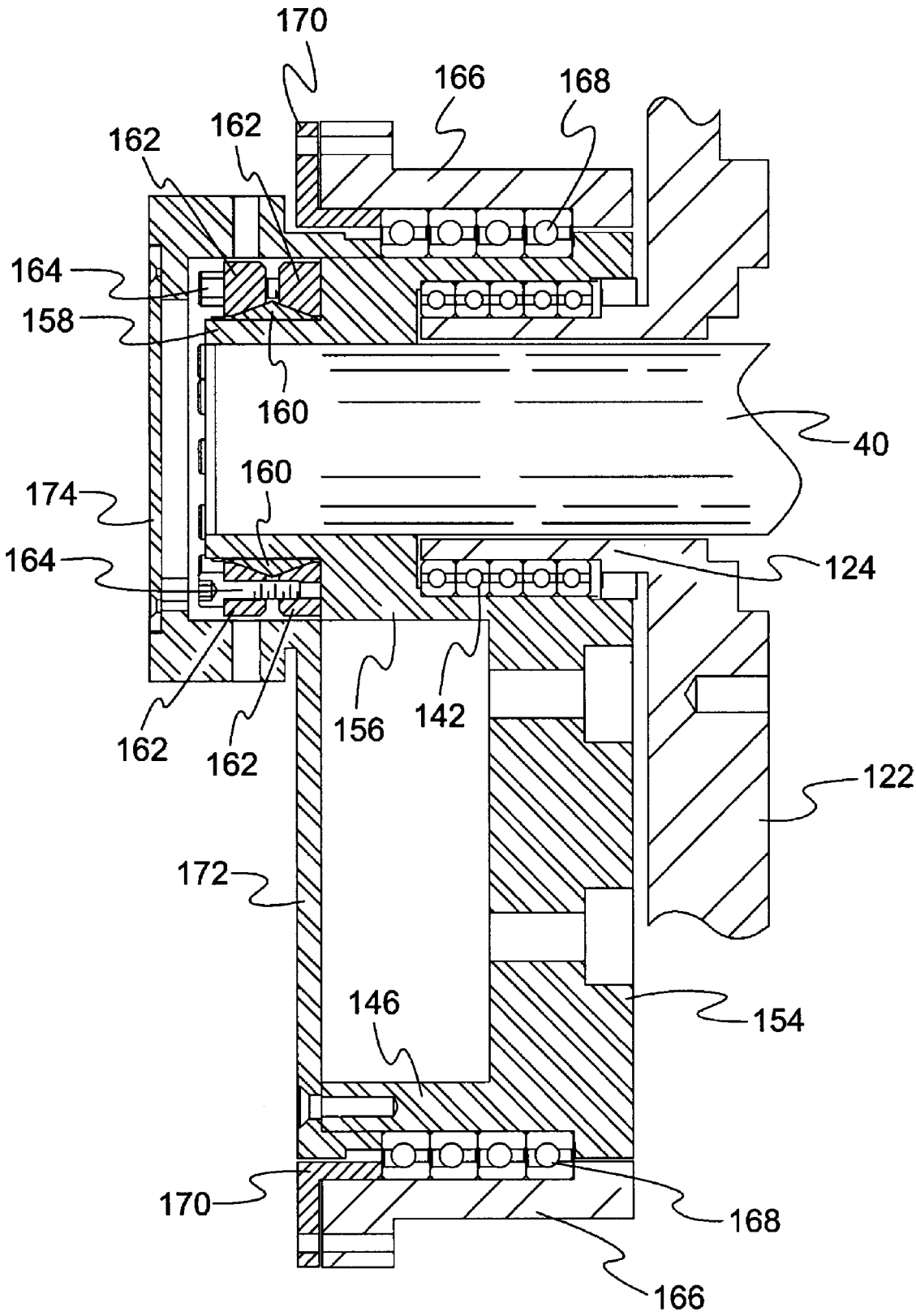
FIG. 25 is a view similar to FIG. 24, showing a modified arrangement for interconnecting the crank hub and planetary shaft.

FIG. 25 shows a modified crank hub 154 in which a modified mounting hub portion 156 is configured with a dual diameter bore. The larger diameter through the rear of the hub 156 fits crank hub bearings 142. A smaller diameter through the front of the hub 156 fits the extending front portion of planetary shaft 40 and is sized to close the gap in front of sleeve 124. A nose 158 of the mounting hub 156 has reduced wall thickness in a portion overlying of the smaller diameter bore to establish a shrink zone that can be compressed to a shrink fit with the front portion of shaft 40.

A shrink disc 160 is applied to the outer surface of the modified mounting hub 156 over hub nose 158 to compress the shrink zone against shaft 40. The disc 160 has a double taper on its outer face. A pair of clamping rings 162 is slightly larger than disc 160 in order to compress against the opposite tapers as locking screws 164 draw rings 162 toward one another. The locking screws 164 are torqued to radially compress both the shrink disc 160 and nose 158 of mounting hub 156 to establish the shrink fit connection.

A keyless fastener such as a shrink disc locking assembly is suitable for use in several locations within the bodymaker gearbox 20, 20' or bodymaker 120. In addition to the specific applications described, above, such a fastener may attach the planetary gear 34 to the planetary gear shaft 40 and may attach ring gear 32 to gearbox housing 26.

In either embodiment of the crank hub 140, drive hub 146 carries a freely rotating outer ring 166. Suitable outer ring bearings 168 carry the ring 166 on the drive hub 146. A thrust ring 170 retains the bearings 168 in place between the drive hub 146 and free ring 166. A crank hub cover plate 172 closes the front face of the crank hub 140 at the drive hub portion 146. In addition, the cover plate 172 retains the inner race of bearings 168 against an inner shoulder on the peripheral face of crank hub 140. A planetary shaft cover plate 174 closes the front face of the crank hub at the mounting hub portion 144 or 156, over the front end of the planetary shaft 40.

The free ring 166 provides a means for linear translation of the rams 60, 66 in a purely linear stroke. The free ring 166 is a stable base for the rams that is able to rotate with respect to the crank hub 140, which allows the free ring 166 to move in translation with respect to the main shaft 30 and drive housing 26. The term, "translation" in physics means movement of a body in which every point of the body moves parallel to and the same distance as every other point of the body; a nonrotational displacement. It should be appreciated that theoretical translation may be unachievable in a real world setting, and the movement of the free ring 166 can only approximate theoretical translation. However, free ring 166 is arranged to achieve a high degree of real world translation in which the free ring 166 translates linearly on a longitudinal axis of ram movement. Ideally, the free ring 166 operates at or outside the periphery of the crank hub 140, such as at the circumference of the crank hub 140, on the periphery of the driving hub portion 146. Placing the free ring 166 on as large a supporting hub as possible allows achievement of a high degree of translational accuracy.

As described, the circular crank hub 140 is able to drive one or more rams 60, 66 with improved accuracy. One or more ram carriers 176 can be connected to the freely rotating outer ring 166 to receive a ram and to move the ram through its stroke. A ram carrier 176 may be formed of a connecting block 178 that is fastened to the ring 166. When two ram carriers 176 are employed, they are mounted at opposite ends of a diameter of ring 166. Each ram carrier defines a ram bore for receiving the end of a ram 60, 66. The ram carrier may retain an inserted ram 60, 66 in the ram bore by a compression fit. A compression ring or retainer ring 180 is placed concentrically to each ram bore at the mouth of the ram bore in the connecting block to establish a suitable compression fit. A keeper 182 fits against the compression ring, pressing it against the annular face of the connecting block 178 by means of bolts. A retainer nut 184 screws to the connecting block over the keeper 182 to ensure stability of the ram carrier assembly 176.

Figure 17:
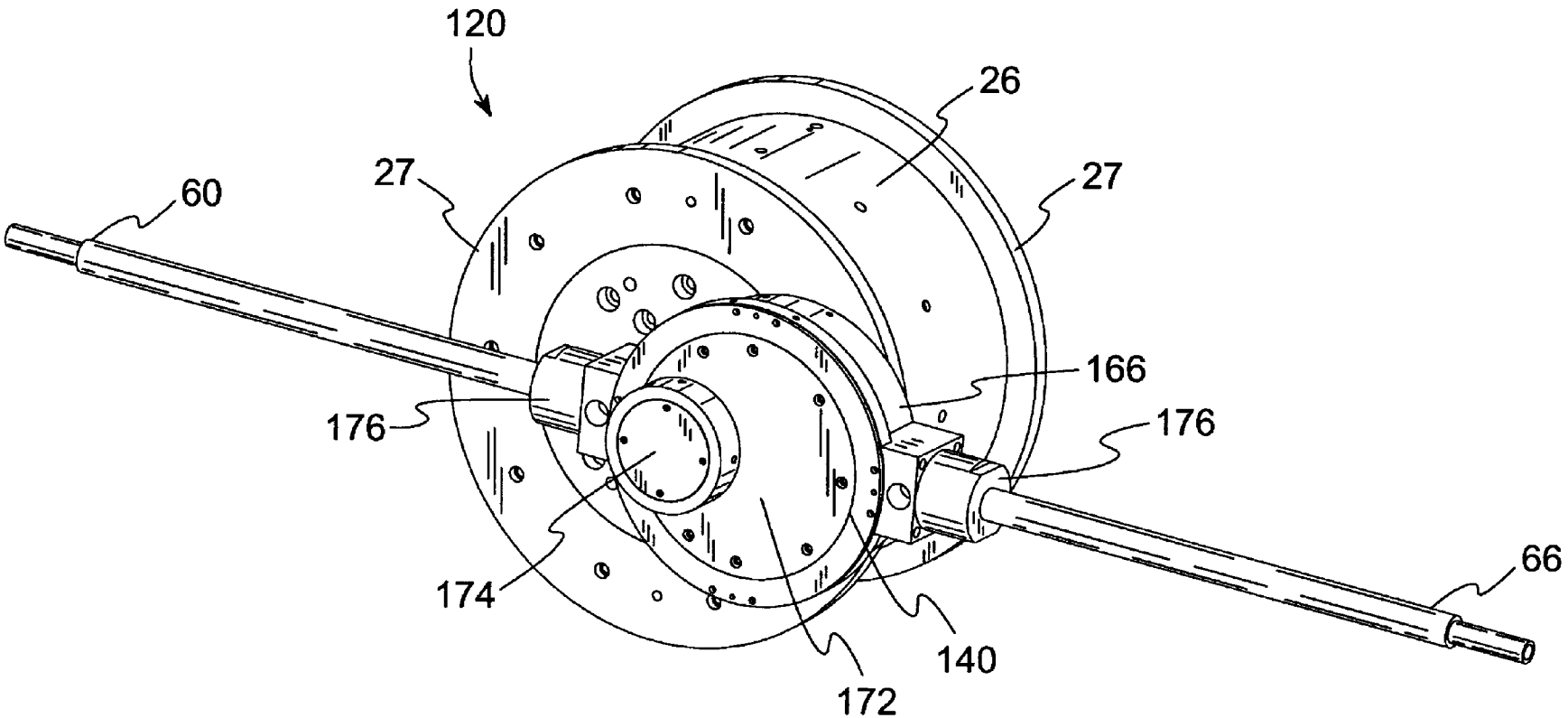
FIG. 17 is an isometric view of a third embodiment of the bodymaker, showing a crank hub and rams in a three o'clock position.

The operation of the third embodiment moves the ram 60, 66 through a reciprocating stroke with improved accuracy and linearity. FIGS. 17-20 show the sequence of operation. FIG. 17 can be compared with FIG. 8. The planetary shaft, which is positioned under cover 174 in this view, is displaced to the right, or to a 3:00 o'clock position. The crank hub 140 is eccentrically disposed by maximum displacement toward the right of the planetary shaft 40 or cover 174, also a 3:00 o'clock position. Similarly, the free ring 166 is disposed in a maximum-right position. The right ram 66 is extended to its full stroke to the right, while the left ram 60 is retracted by full stroke. The view of FIG. 17 can be referred to as showing the 3:00 o'clock position.

Figure 18:
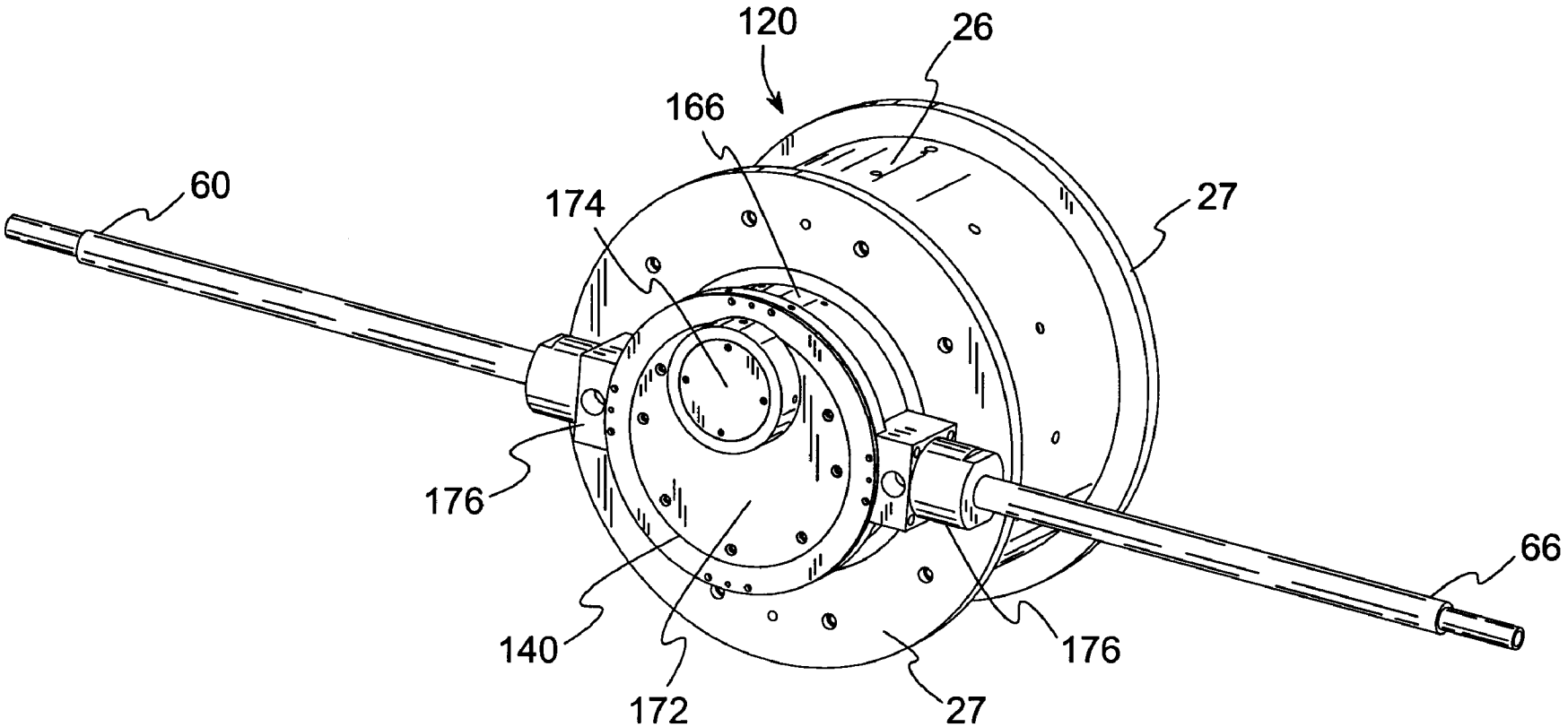
FIG. 18 is a view similar to FIG. 17, showing the crank hub and rams in a twelve o'clock position.

FIG. 18 can be compared to FIG. 10. The planetary shaft is displaced by maximum displacement to an upward, vertical direction, as indicated in this view by the position of cover 174. The crank hub 140 is eccentrically displaced downwardly from the position of the planetary shaft, resulting in the crank hub 140 and free ring 166 residing in a concentric position with respect to drive housing 26. Relative to the positions shown in FIG. 17, the crank hub has rotated clockwise by ninety degrees with respect to the free ring 166. The rams 60, 66 are at mid-stroke. The free ring 166 has translated from the right-extending position in FIG. 17 to the mid-position of FIG. 18. This configuration may be referred to as a 12:00 o'clock position.

Figure 19:
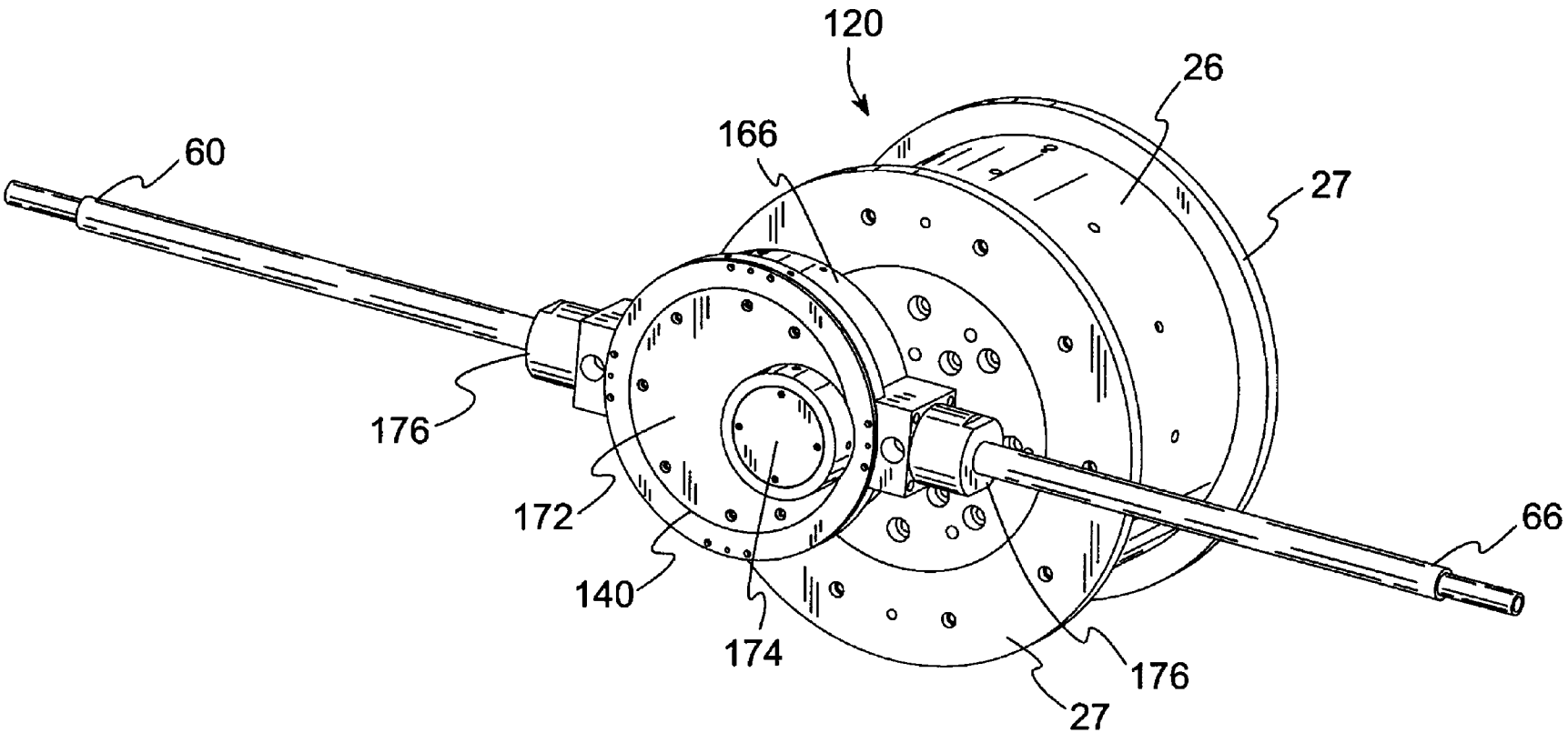
FIG. 19 is a view similar to FIG. 17, showing the crank hub and rams in a nine o'clock position.

FIG. 19 can be compared to FIG. 12. The position of the planetary shaft is disposed to the left, or to a 9:00 o'clock position as indicated by the position of cover plate 174. The crank hub 140 is eccentrically disposed by maximum displacement to the left of the planetary shaft or cover 174, at a 9:00 o'clock position. The free ring 166 has translated from the concentric or mid-position of FIG. 18 to a left-extending position in FIG. 19. The right ram 66 is retracted by its full stroke toward the housing 26, while the left ram 60 is extended by full stroke to the left. Relative to the positions shown in FIG. 18, the crank hub 140 has rotated clockwise by ninety degrees with respect to the free ring 166. The view of FIG. 19 can be referred to as showing a 9:00 o'clock position.

Figure 20:
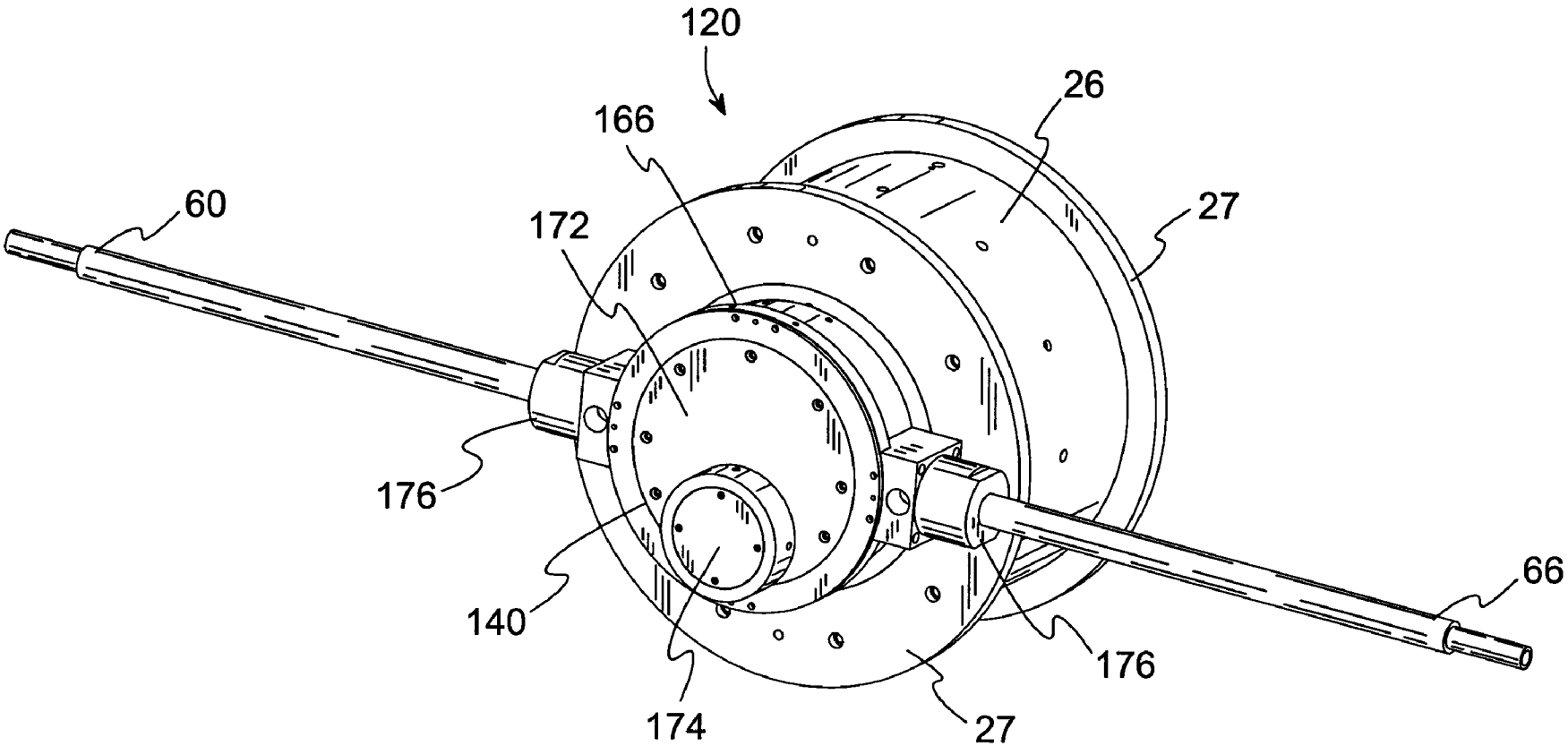
FIG. 20 is a view similar to FIG. 17, showing the crank hub and rams in a six o'clock position.

In FIG. 20, the position of the planetary shaft is shown by the position of planetary shaft cover 174, which displaced by maximum displacement downward to a 6:00 o'clock position. The crank hub 140 is eccentrically displaced upwardly from the planetary shaft cover 174, resulting in the crank hub 140 and free ring 166 residing in a concentric position with respect to drive housing 26. Relative to the positions shown in FIG. 19, the crank hub has rotated clockwise by ninety degrees with respect to the free ring 166. The rams 60, 66 are at mid-stroke. The free ring 166 has translated from the left-extending position in FIG. 19 to the mid-position of FIG. 20. This configuration may be referred to as a 6:00 o'clock position.

Thus, as described, the third embodiment of the bodymaker 120 provides a substantial improvement in the linearity of ram movement. This improvement is achieved by driving an annular crank 140 with a hypocycloid gear mechanism. In turn, the annular crank establishes a rotational means for moving a ram in a linear stroke. A free ring 166 riding on the crank 140 near its periphery or outer extreme establishes a translational moving means for moving a ram in a linear stroke. The rotational crank and translational ring provide a drive system for a ram with highly refined linear motion. The arrangement and mounting of the circular crank hub 144 minimizes manufacturing runout tolerances.

In addition, the third embodiment of the bodymaker 120 maintains parallelism among the main bearings 38, 48, side cover plates 122, 52, sleeve 124, and related output components. The rams 60, 66 are now aligned with both the outer ring 166 and the sleeve 124. This arrangement distributes forces directly in line with both the outer ring bearings 168 and the crank hub bearings 142. Significantly, the forces imposed by the rams are distributed among durable and massive housing components such as the sleeve 124, front cover plate 122, and front hub 134. These components are supported by highly durable bearings such as main bearings 48 that can withstand the forces from the rams. The planetary shaft 40 is protected from deflection due to ram forces. Particularly at the front end of the planetary shaft 40, ram forces generally are not transmitted to the planetary shaft 40, with the result that the front end of planetary shaft 40 has substantially no tendency to radially deflect due to ram operation. Instead, sleeve 124 receives forces from the rams and, due to the clearance or gap maintained between the sleeve 124 and shaft 40, protects the shaft 40 from receiving deflective forces.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A can bodymaker, comprising:

a machine frame;

a bodymaker drive mechanism carried on the machine frame; and a ram carried on the machine frame;

wherein said drive mechanism is formed of a major ring carried in stationary position with respect to said machine frame and a minor planetary ring carried on the frame for rolling orbital motion against the inside circumference of said major ring, such that said minor planetary ring rolls on a minor ring central axis that orbits the major ring central axis, and said planetary ring has a diameter of one-half the diameter of the major ring, whereby each point on the circumference of the minor ring tracks a straight-line path of movement along an axis of motion that is parallel to a diameter of the major ring;

and further comprising:

a crank device attached to the drive mechanism for movement with said minor ring central axis and having a tracking point offset from the minor ring central axis and aligned with a selected point at the circumference of the minor ring, such that the tracking point tracks a preselected straight-line path that is parallel to a preselected diameter of the major ring;

wherein:

said crank device is connected to said ram for driving the ram in synchronization with movement of the tracking point on a predetermined straight-line path that is parallel to said preselected diameter of the major ring; and the machine frame is configured to support said ram for straight-line reciprocation on said preselected straight-line path.

2. The can bodymaker of claim 1, wherein said ram is a first ram, and further comprising:

a second ram opposed to said first ram and connected to said crank device such that each ram reciprocates on an axis parallel to said selected diameter of the major ring.

3. The can bodymaker of claim 1, wherein said major ring comprises an internal ring gear.

4. The can bodymaker of claim 3, wherein said minor ring comprises a planetary gear having a pitch diameter equal to one-half the pitch diameter of said internal ring gear.

5. The can bodymaker of claim 1, wherein said selected diameter of the major ring is horizontal, such that said preselected straight-line path is horizontal.

6. The can bodymaker of claim 1, wherein said bodymaker drive mechanism further comprises:

a drive housing mounted to said machine frame and carrying said major ring in fixed relative position with respect thereto;

a first rotary support carried for rotation with respect to said drive housing about a first rotary support central axis that is collinear with the major ring central axis, wherein the first rotary support carries said minor planetary ring from a first side thereof on a minor planetary ring central axis, and wherein the minor planetary ring central axis is offset from and parallel to the first rotary support central axis, such that rotation of the first rotary support orbits the minor planetary ring with respect to the major ring central axis.

7. The can bodymaker of claim 6, wherein said bodymaker drive mechanism further comprises:

a second rotary support carried for rotation with respect to said drive housing about a second rotary support central axis, collinear with said first rotary support central axis, and carrying said minor planetary ring from a second side thereof;

a spacer carried between the first and second rotary supports for rotation therewith and counterbalancing the minor planetary ring for orbital motion; and means fastening together the first and second rotary supports and said spacer into a carrier block for the minor planetary ring.

8. The can bodymaker of claim 6, further comprising:

a planetary shaft located on the minor planetary ring central axis, connected to rotate in unison with the minor planetary ring;

wherein:

said first rotary support is located on a front side of the minor planetary ring, defines a through-bore receiving a front end of said planetary shaft, and further defines a sleeve that extends the bore on the front side of the first rotary support and protrudes from the front of the first rotary support such that an outer surface of the sleeve is exposed;

said crank device is mounted on said outer surface of the sleeve such that the sleeve supports the crank device for rotation; and a fastener interconnects the crank device and planetary shaft for rotation in unison.

9. The can bodymaker of claim 8, wherein:

said crank device is an annular crank hub that includes mounting hub carrying the annular crank hub on said sleeve;

said mounting hub and planetary shaft extend from the front of the sleeve and are radially spaced apart by an annular gap at the front end of the sleeve; and said fastener is a radially expanding ring fastener and is located in the annular gap, applying expansive radial pressure to both the output device and planetary shaft.

10. The can bodymaker of claim 8, wherein:

said crank device is an annular crank hub that includes a mounting hub carrying the annular crank hub on said sleeve;

said mounting hub and planetary shaft extend from the front of the sleeve;

said mounting hub defines a dual diameter bore wherein a larger diameter rear portion fits the sleeve and a smaller diameter front portion fits the extending front portion of the planetary shaft; and said fastener is a radially compressive ring fastener and is located over the mounting hub at said front portion of the bore, compressing the mounting hub against the planetary shaft.

11. The can bodymaker of claim 1, wherein:

said crank device is an annular crank hub with a centerpoint concentric with said tracking point and having a eccentrically located mounting hub connected to said bodymaker drive mechanism to move with said minor ring central axis;

further comprising:

a ring concentrically mounted on a peripheral surface of said annular crank hub for concentric rotation with respect to crank hub centerpoint; and first means for connecting said ram to said ring, connecting the ram to the ring and retaining the ring in static rotational relationship with respect to said machine frame while permitting the ring to move with substantial translation while tracking the preselected straight-line path of the annular crank hub.

* * * * *